US011898824B2

(12) United States Patent
Sloman

(10) Patent No.: US 11,898,824 B2
(45) Date of Patent: Feb. 13, 2024

(54) RESPONDING TO AN EXPLOSION LOCAL TO AN ARMOURED VEHICLE

(71) Applicant: ADVANCED BLAST & BALLISTIC SYSTEMS LIMITED, Derby (GB)

(72) Inventor: Roger Mark Sloman, Derby (GB)

(73) Assignee: Advanced Blast & Ballistic Systems Limited, Derby (GB)

( * ) Notice: Subject to any disclaimer, the term of this patent is extended or adjusted under 35 U.S.C. 154(b) by 0 days.

(21) Appl. No.: 17/636,758

(22) PCT Filed: Aug. 18, 2020

(86) PCT No.: PCT/GB2020/015970
§ 371 (c)(1),
(2) Date: Feb. 18, 2022

(87) PCT Pub. No.: WO2021/032968
PCT Pub. Date: Feb. 25, 2021

(65) Prior Publication Data

US 2023/0375311 A1 Nov. 23, 2023

(30) Foreign Application Priority Data

Aug. 20, 2019 (GB) ..... 1911943

(51) Int. Cl.
*F41H 7/04* (2006.01)

(52) U.S. Cl.
CPC ..... *F41H 7/042* (2013.01)

(58) Field of Classification Search
CPC ..... F41H 7/042; F41H 7/044
USPC ..... 89/36.08, 36.17
See application file for complete search history.

(56) References Cited

U.S. PATENT DOCUMENTS

| | | | |
|---|---|---|---|
| 4,326,445 | A | 4/1982 | Bemiss |
| 5,663,520 | A | 9/1997 | Ladika et al. |
| 6,345,563 | B1 | 2/2002 | Middione et al. |
| 6,658,984 | B2 | 12/2003 | Zonak |
| 7,114,764 | B1 | 10/2006 | Barsoum et al. |
| 8,418,597 | B2 | 4/2013 | Pavon |

(Continued)

FOREIGN PATENT DOCUMENTS

| | | | |
|---|---|---|---|
| DE | 102012001995 A1 | 8/2013 | |
| EP | 2325595 A2 * | 5/2011 | ..... F41H 5/007 |

(Continued)

OTHER PUBLICATIONS

International Search Report and Written Opinion for International Application No. PCT/GB20/51970, dated Jan. 21, 2021, 18 pages.

*Primary Examiner* — Reginald S Tillman, Jr.
(74) *Attorney, Agent, or Firm* — Suiter Swantz pc llo

(57) ABSTRACT

A blast countermeasure for a vehicle, such as an armoured vehicle, is provided. The blast countermeasure comprises: at least one explosive; a detonator for detonating the explosive; and at least one reflector, located at least partially above the at least one explosive, for reflecting a shock wave generated by detonation of the at least one explosive groundwards in order to apply a groundwards force to the vehicle.
The vehicle may comprise: control circuitry configured to respond to detection of an explosion local to the vehicle by activating an actuator to generate a groundwards force and cause a cabin floor of the vehicle to move groundwards.

20 Claims, 15 Drawing Sheets

(56) References Cited

U.S. PATENT DOCUMENTS

| | | | | |
|---|---|---|---|---|
| 9,016,186 | B2 * | 4/2015 | Asaf | F41H 5/007 89/36.17 |
| 9,677,857 | B2 * | 6/2017 | Svane | F41H 5/007 |
| 9,989,013 | B2 * | 6/2018 | Sloman | F02K 9/346 |
| 10,119,789 | B2 * | 11/2018 | Sloman | F41H 5/007 |
| 11,313,652 | B1 * | 4/2022 | Burguess | F41H 7/044 |
| 2003/0010189 | A1 | 1/2003 | Zonak | |
| 2006/0048641 | A1 | 3/2006 | Gonzalez | |
| 2006/0086243 | A1 | 4/2006 | Seo et al. | |
| 2006/0201319 | A1 | 9/2006 | Wet | |
| 2007/0017361 | A1 | 1/2007 | Zank et al. | |
| 2010/0319525 | A1 | 12/2010 | Pavon | |
| 2016/0313093 | A1 * | 10/2016 | Hiemenz | F41H 7/042 |
| 2017/0008571 | A1 * | 1/2017 | Hiemenz | F41H 7/042 |

FOREIGN PATENT DOCUMENTS

| | | | | |
|---|---|---|---|---|
| EP | 2762825 | A2 | 8/2014 | |
| WO | 0239048 | A2 | 5/2002 | |
| WO | 2006108613 | A1 | 10/2006 | |
| WO | 2011148118 | A1 | 12/2011 | |
| WO | WO-2012052768 | A1 * | 4/2012 | F41H 7/042 |
| WO | 2014111709 | A1 | 7/2014 | |
| WO | 2019030465 | A1 | 2/2019 | |

* cited by examiner

RESPONDING TO AN EXPLOSION LOCAL TO AN ARMOURED VEHICLE

CROSS-REFERENCE TO RELATED APPLICATIONS

The present application is related to and claims benefit of the earliest available effective filing date from the following applications: The present application constitutes a National Phase application of PCT Application Number PCT/GB2020/051970, filed Aug. 18, 2020, which claims priority to Patent Application No. GB1911943.7, filed Aug. 20, 2019, whereby the above-listed applications are incorporated herein by reference in their entirety.

TECHNOLOGICAL FIELD

Embodiments of the present invention relate to responding to an explosion local to an armoured vehicle. In particular, they relate to performing protective actions to mitigate the effect of such an explosion on the occupants of an armoured vehicle.

BACKGROUND

An explosive event can cause significant trauma to a vehicle and/or a vehicle's occupants. In order to protect the occupants of the vehicle from shrapnel and blast emanating from an explosive such as a bomb, mine or improvised explosive device (IED), some vehicles comprise armour.

The armour may protect the occupants against injury caused directly from the shrapnel and blast effects. However, depending upon the size of the explosive, some aspects of the vehicle (such as the base of the vehicle if the explosion occurs underneath the vehicle) can be very heavily damaged. Furthermore, an explosion underneath or to the side of a vehicle may cause the vehicle to accelerate rapidly into the air, resulting in injury to the occupants either when being accelerated upwards or when the vehicle lands on the ground.

BRIEF SUMMARY

According to various, but not necessarily all, embodiments there is provided a blast countermeasure, comprising: at least one explosive; a detonator for detonating the explosive; and at least one reflector, located at least partially above the at least one explosive, for reflecting a shock wave generated by detonation of the at least one explosive groundwards in order to apply a groundwards force to the vehicle.

The blast countermeasure may further comprise: at least one mass, for providing a reactionary force upon detonation of the at least one explosive, to apply a further groundwards force to a vehicle.

The reflector may be located at least partially between the mass and the explosive. The mass may be situated on the reflector. The mass may be a non-gaseous mass.

The reflector may be made from at least one metal. The reflector may be substantially planar.

The blast countermeasure may further comprise: a housing arranged to house at least the reflector and the explosive. The housing may comprise a base. The explosive may be located on the base. The housing may further comprise at least one side wall. The side wall may include at least one vent for relieving pressure within the housing generated by detonation of the explosive.

The vehicle may be an armoured vehicle. The blast countermeasure may be for location between a blast shield of the armoured vehicle and a cabin floor of the armoured vehicle. The groundwards force may be applied to the blast shield.

The blast countermeasure may further comprise: a shock wave attenuator for attenuating a portion of a shock wave, generated by the detonation of the explosive, directed towards the cabin floor. The shock wave attenuator may comprise a resilient material.

The explosive(s) may include a high explosive and/or detonating cord.

According to various, but not necessarily all, embodiments there is provided a vehicle comprising the blast countermeasure.

According to various, but not necessarily all, embodiments there is provided a blast countermeasure for location between a blast shield of an armoured vehicle and a cabin floor of the armoured vehicle, the blast countermeasure comprising: at least one explosive; a detonator for detonating the explosive; a shock wave attenuator for attenuating a portion of a shock wave, generated by the detonation of the explosive, directed towards the cabin floor; and at least one mass, at least partially located between the shock wave attenuator and the explosive, for providing a reactionary force upon detonation of the explosive to apply a groundwards force to the blast shield.

The mass may be at least one non-gaseous mass. The blast countermeasure may further comprise a housing which is arranged to house at least: the shock wave attenuator, the mass and the explosive.

The housing may comprise a base. The explosive may be at least partially located between the mass and the base. The explosive may be located on the base.

The housing may comprise an upper wall.

The blast countermeasure may further comprise at least one side wall. The side wall(s) may include at least one vent for relieving pressure within the housing generated by detonation of the explosive. The blast countermeasure may further comprise a further shock wave attenuator located at least partially between the explosive and the side wall.

The blast countermeasure may further comprise at least one reflector located at least partially between the mass and the shock wave attenuator.

The shock wave attenuator and/or the further shock wave attenuator may comprise a resilient material.

The explosive may include a high explosive and/or detonating cord.

According to various, but not necessarily all, embodiments there is provided a vehicle comprising the blast countermeasure.

According to various, but not necessarily all, embodiments there is provided an armoured vehicle, comprising: a cabin floor; a blast shield located at the underside of the armoured vehicle; at least one detector for detecting an explosion local to the armoured vehicle; at least one blast countermeasure, located between the blast shield and the cabin floor, comprising at least one explosive; and control circuitry configured to respond to detection of an explosion local to the armoured vehicle by causing the at least one blast countermeasure to detonate the explosive and apply a groundwards force to the blast shield.

The blast countermeasure may be coupled to the cabin floor. The blast countermeasure may be configured to pull the cabin floor groundwards.

The blast countermeasure may be configured such that detonation of the explosive causes the blast countermeasure to pull the cabin floor groundwards. The blast countermeasure may be configured to apply the groundwards force to the blast shield and pull the cabin floor groundwards substantially simultaneously.

The blast countermeasure may be coupled to the cabin floor, at least in part, by one or more levers. The blast countermeasure may be configured such that detonation of the explosive causes the one or more levers to pull the cabin floor groundwards.

The armoured vehicle may comprise at least one elongate strengthening member, located between the cabin floor and the blast shield, for strengthening the resistance of the blast shield to an explosion. At least one blast countermeasure may be located on an elongate strengthening member.

The elongate strengthening member may include adjacent first and second elongate strengthening members. At least one blast countermeasure may be located between the adjacent first and second elongate strengthening members.

A plurality of blast countermeasures may be provided that are located between the blast shield and the cabin floor.

According to various, but not necessarily all, embodiments there is provided an apparatus, comprising: at least one detector for detecting an explosion local to an armoured vehicle; at least one blast countermeasure, for location between a blast shield of the armoured vehicle and a cabin floor of the armoured vehicle, comprising at least one explosive; and control circuitry configured to respond to detection of an explosion local to the armoured vehicle by causing the at least one blast countermeasure to detonate the explosive and apply a groundwards force to the blast shield.

According to various, but not necessarily all, embodiments there is provided an armoured vehicle, comprising: at least one detector for detecting an explosion local to the armoured vehicle; a cabin floor; at least one actuator, coupled to the cabin floor, for generating a force to cause at least a portion of the cabin floor to be pulled groundwards; and control circuitry configured to respond to detection of an explosion local to the armoured vehicle by activating the actuator to cause the cabin floor to move groundwards.

The armoured vehicle may further comprise a tractor configured to pull at least a portion of the cabin floor groundwards in response to generation of the force by the actuator. The tractor may be connected to an underside of the cabin floor. The tractor may comprise at least one spring, at least one rod, at least one cable and/or at least one chain.

The actuator may comprise an explosively driven actuator. The explosively driven actuator may comprise multiple explosive cartridges. Each explosive cartridge may enable a force to cause the cabin floor groundwards to be pulled groundwards on a separate occasion.

At least a portion of the cabin floor may be fixedly positioned within the vehicle. The cabin floor may be configured to flex upon actuation of the actuator. The cabin floor may be configured to return to its original position after generation of the groundwards force by the actuator. The cabin floor may be fixedly positioned within the vehicle along at least a portion of the periphery of the cabin floor. The portion of the cabin floor that is pulled groundwards upon actuation of the actuator may be located away from the periphery of the cabin floor.

According to various, but not necessarily all, embodiments there is provided an apparatus, comprising: at least one detector for detecting an explosion local to an armoured vehicle; at least one actuator, for coupling to a cabin floor of the armoured vehicle, configured to generate a force to pull at least a portion of the cabin floor groundwards; and control circuitry configured to respond to detection of an explosion local to the armoured vehicle by activating the actuator to cause the cabin floor to move groundwards.

According to various, but not necessarily all, embodiments there is provided an armoured vehicle, comprising: detecting means for detecting an explosion local to the armoured vehicle; force generation means for generating a force to cause at least a portion of the cabin floor to be pulled groundwards; and control means for responding to detection of an explosion local to the armoured vehicle by activating the force generation means to cause the cabin floor to move groundwards.

According to various, but not necessarily all, embodiments there is provided a method, comprising: detecting an explosion local to an armoured vehicle; and pulling a cabin floor of the armoured vehicle groundwards in response to detection of the explosion.

BRIEF DESCRIPTION

Some examples will now be described with reference to the accompanying drawings in which.

DETAILED DESCRIPTION

An explosive event local to a land-based vehicle can cause significant trauma to a vehicle and/or a vehicle's occupants. In order to protect the occupants of the vehicle from shrapnel and blast emanating from an explosive such as a bomb, mine or improvised explosive device (IED), some vehicles comprise armour.

The armour may protect the occupants of the vehicle against injury caused directly from the shrapnel and blast effects. However, an explosion underneath or to the side of a vehicle may cause the vehicle to accelerate rapidly into the air, resulting in injury to the occupants either when being accelerated upwards or when the vehicle lands on the ground. Such an explosion may also cause the cabin floor of the vehicle to vibrate rapidly, which may injure the occupants' legs and feet if they are in contact with the cabin floor and may project unsecured items on the floor of the cabin into the air.

The detonation of a mine generates an initial shock wave which is very quickly followed by a blast wave. If the detonation occurs underneath the vehicle, these events cause damage to the vehicle and contribute to the vehicle being accelerated upwards into the air.

Immediately after the explosion occurs, there is an input of energy from the initial shock wave, the following reflected pressure waves, ejecta, and from localised very high-pressure gas. Over the next few milliseconds, the gases produced by decomposition of the explosive from the mine expand underneath the vehicle and together with other contributors (to the total impulse imparted to the vehicle) may apply a large enough force to cause the vehicle to accelerate upwards into the air and fall onto its side or top. The effect of the expanding gases can be likened to a large airbag expanding very rapidly under the vehicle.

Figure 1A:
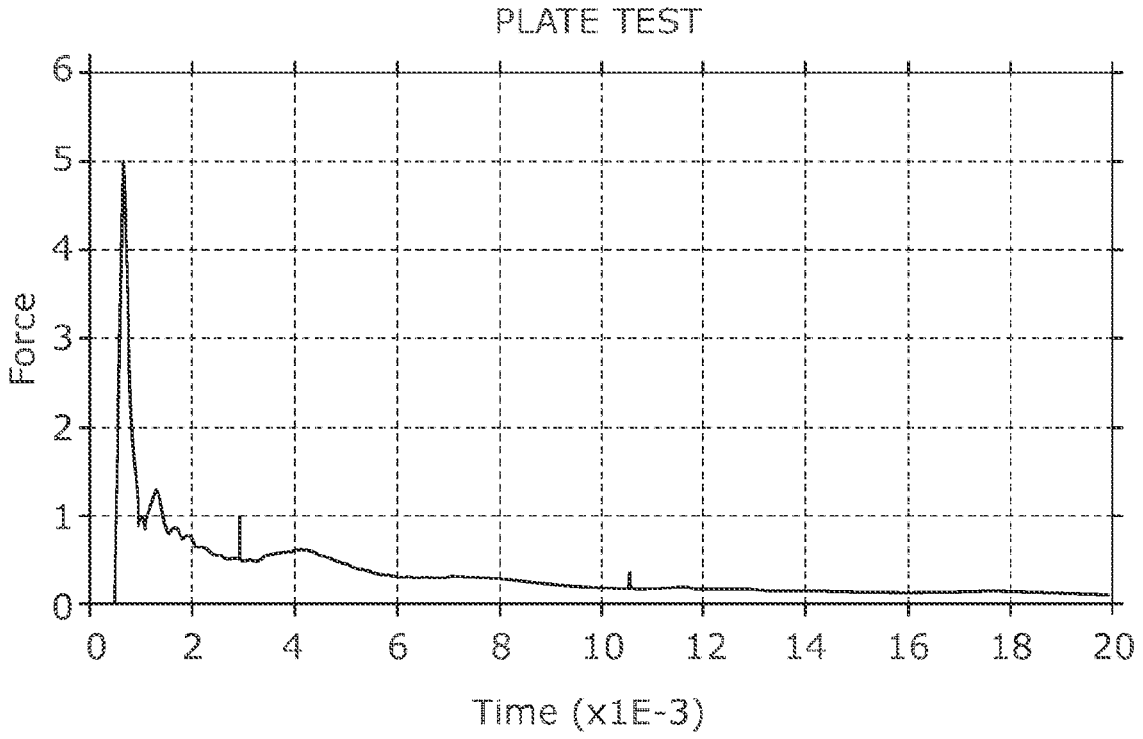
FIG. 1A illustrates an example of a force versus time graph for a force generated by a bomb, a mine or an IED local to a vehicle.

FIG. 1A illustrates an example of an example of a force vs time graph for an upwards force that is applied to an armoured vehicle when an explosion occurs local to the vehicle (e.g. due to detonation of a mine underneath the vehicle). It can be seen from FIG. 1A that the force imparted to the vehicle (by the initial shock wave) is much higher over the first millisecond or so than it is following that period. It is this initial high magnitude, short duration impulse caused by the shock wave that initially loads the blast shield/belly plate positioned at the underside of an armoured vehicle and it may cause the blast shield to fail.

Embodiments of the invention advantageously mitigate the effects of a local explosion on an armoured vehicle. Some aspects relate to blast countermeasures that counteract the initial 1-2 millisecond upward force that occurs following an explosion by applying an opposing groundwards force to the blast shield of the armoured vehicle. Other aspects relate to retracting the cabin floor of the vehicle to decouple the cabin floor from the occupants' feet, in order to mitigate/prevent injury to the occupants.

Figure 2:
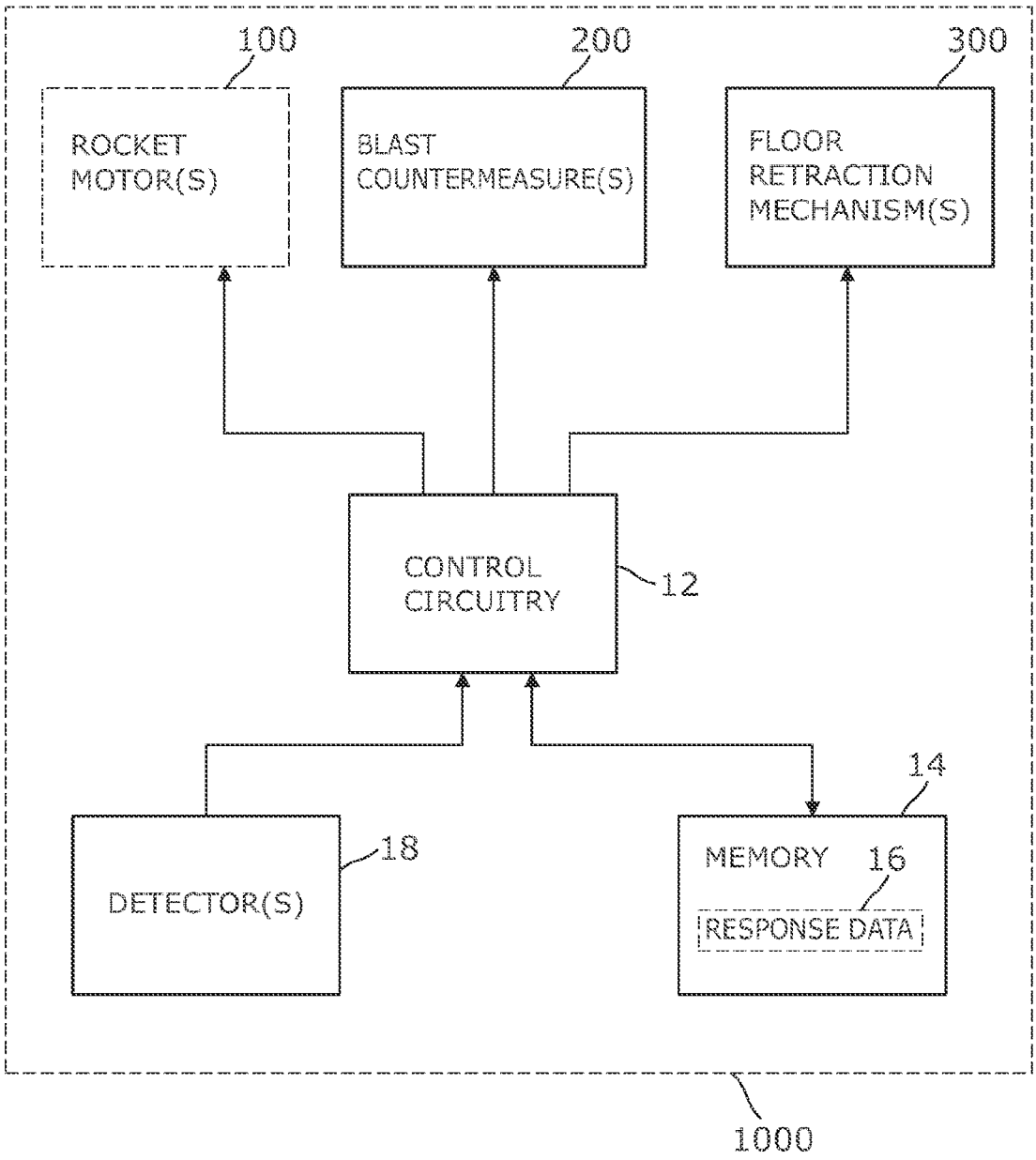
FIG. 2 illustrates a schematic of an apparatus for responding to an explosion local to a vehicle.

FIG. 2 illustrates a vehicle protection apparatus 1000 that forms part of a land-based vehicle. The vehicle protection apparatus 1000 mitigates/prevents the damage caused to a vehicle by an explosion by counteracting the forces generated by the explosion and stabilising the vehicle in response to the explosion. It may, advantageously, enable injury to the vehicle's occupants to be prevented or limited and enable the vehicle to remain upright and in fighting condition. This is explained in further detail below.

The vehicle protection apparatus 1000 illustrated in FIG. 2 may be applied to a vehicle during manufacture or post manufacture. The apparatus 1000 may, for example, be a kit of parts. The vehicle may be a land-based armoured vehicle. For example, the vehicle may be a civilian car, a modified sports utility vehicle, a lightweight special forces vehicle or a larger military armoured vehicle such as a personnel carrier.

The apparatus 1000 comprises one or more blast countermeasures 200, such as those described below in relation to FIGS. 3A to 6 and FIGS. 10 to 14 below, one or more floor retraction mechanisms 300 such as those described below in relation to FIGS. 7A to 14, one or more detectors 18, control circuitry 12 and memory 14. In some implementations, the apparatus 1000 includes the one or more blast countermeasures 200 and the floor retraction mechanism(s) 300. In some of these implementations, such as those discussed below in relation to FIGS. 10 to 14, the blast countermeasures 200 might also provide at least part of the floor retraction mechanism 300. In other implementations, the apparatus 1000 might include the floor retraction mechanism (s) 300 and not the one or more blast countermeasures 200, or it might include the one or more blast countermeasures 200 and not the floor retraction mechanism(s) 300. In all of these implementations, the one or more rocket motors 100 are optional.

If present, the rocket motors 100 are configured to apply a groundwards force to the vehicle when an explosion occurs local to the vehicle. The force applied by the rocket motors 100 is intended to counter the longer-term upwards forces mentioned above that would otherwise cause the vehicle to accelerate rapidly into the air. The rocket motors 100 might, for example, be the same or similar to the "linear rocket motors" described in PCT patent application publication number WO 2014/111709. Additionally or alternatively, mass ejection devices may be used to apply the groundwards force to the vehicle, such as those described in PCT patent application number WO 2011/148118.

Figure 1B:
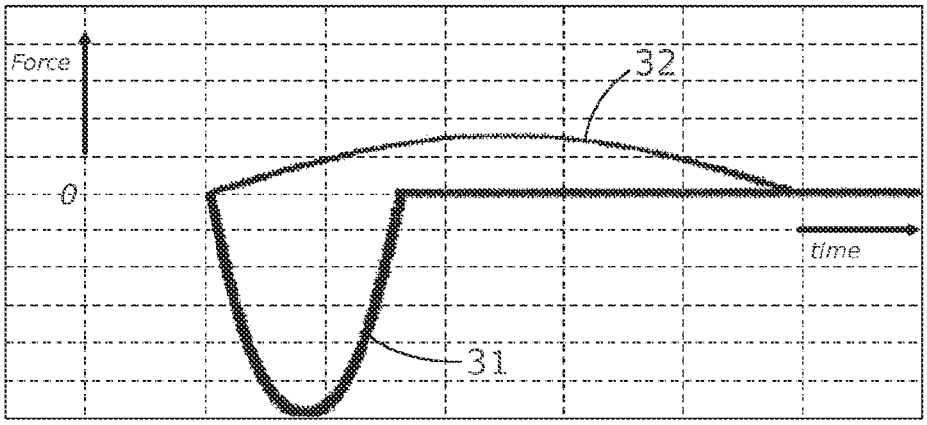
FIG. 1B illustrates an example of a force versus time graph for first and second forces generated by a blast countermeasure.

The blast countermeasures 200 are configured to apply a groundwards force to a blast shield of the vehicle when an explosion occurs local to the vehicle (e.g. underneath the vehicle). FIG. 1B illustrates an example of a force versus time graph for first and second forces generated by a blast countermeasure. This is discussed below, in conjunction with the blast countermeasures 200 illustrated in FIGS. 3A to 6 and 10 to 14.

Each floor retraction mechanism 300 is configured to retract a cabin floor of the vehicle when an explosion occurs local to the vehicle (e.g. underneath the vehicle). Different floor retraction mechanisms 300 are described in detail below in relation to FIGS. 7A to 14.

The control circuitry 12 may, for example, be or comprise a single processor or multiple processors.

The control circuitry 12 is configured to receive inputs from the one or more detectors 18. The control circuitry 12 is configured to provide outputs which cause initiation of: one, some or all of the rocket motors 100; one, some or all of the blast countermeasures 200; and/or the floor retraction mechanism(s) 300.

The control circuitry 12 is also configured to write to and read from memory 14. The control circuitry 12 may control the initiation of the rocket motors 100, the blast countermeasures 200 and/or the floor retraction mechanism(s) 300 in accordance with response data 16 stored in the memory 14. The response data 16 might, for example, specify how the rocket motors 100, the blast countermeasures 200 and/or the floor retraction mechanism(s) 300 should be controlled depending upon the inputs provided by the detectors 18. Such inputs may, for example, indicate the directivity and the magnitude of the blast shock wave caused by an explosion.

It will be appreciated by those skilled in the art that FIG. 2 is a functional schematic. In this regard, it should be recognised that intervening elements (such as additional circuitry) may be positioned between the control circuitry 12 and each of the one or more rocket motors 100, the one or more blast countermeasures 200, the floor retraction mechanism(s) 300, the one or more detectors 18 and the memory 14.

The control circuitry 12 may operate under the control of computer program instructions stored in the memory 14. In an alternative implementation, the control circuitry 12 and/or the memory 14 may be provided by a dedicated application specific integrated circuit (ASIC). In such an implementation, it may be that no computer program is required.

The detectors 18 are for detecting that an explosion has occurred local to (for example, underneath) a vehicle. The detectors 18 may be any type of detectors and may, for example, include: one or more pressure detectors, one or more temperature detectors and/or one or more light detectors.

The pressure detectors may, for example, be piezoelectric pressure detectors. Advantageously, piezoelectric pressure detectors operate effectively in adverse weather and ground conditions. Alternatively or additionally, the detectors 18 may include one or more break wire detectors. An explosion may cause a circuit of such a break wire detector to break, causing the break wire detector to provide an input to the processor 12. Alternatively or additionally, the detectors 18 may include one or more ionisation detectors for detecting ionised particles that result from an explosion. Alternatively or additionally, the detectors 18 may comprise one or more electromagnetic pulse detectors for detecting an electromagnetic pulse resulting from an explosion. Alternatively or additionally, the detectors 18 may comprise one or more accelerometers and/or one or more gyroscopes. Alternatively or additionally, the detectors 18 may comprise one or more strain gauges.

In operation, when an explosion occurs which is external to and local to a land-based vehicle (such as underneath the vehicle), the explosion causes a blast shock wave. The detectors 18 detect that an explosion has occurred local to the vehicle and provide inputs to the control circuitry 12 which are indicative that an explosion has occurred. The control circuitry 12 analyses the inputs provided by the detectors 18 and determines that an explosion has occurred. The control circuitry 12 then responds to the inputs provided by the detectors 18 by initiating the rocket motors 100 (if present), the blast countermeasures 200 (if present) and the floor retraction system(s) 300 (if present). The rocket motors 100, the blast countermeasures 200 and/or the floor retraction system 300 may, for example, be initiated in less than a millisecond of the explosion occurring.

Initiation of the blast countermeasures 200 causes the blast countermeasures 200 to apply a groundwards force to the blast shield of the vehicle, mitigating the initial large upward forces generated by the blast shock wave of the explosion. Initiation of the rocket motors 100 causes a groundwards force to be applied to the vehicle to urge the vehicle towards ground and mitigates the longer term and lower magnitude upward forces generated by the blast shock wave from the explosion. Initiation of the floor retraction mechanism(s) 300 causes the cabin floor in the vehicle to retract, decoupling the cabin floor from the occupants' feet thereby mitigating or preventing injury to the occupants.

In some circumstances, depending on the nature of the vehicle and the explosive threat(s) that the vehicle is expected to face, the rocket motors 100 may be unnecessary. That is, the blast countermeasures 200 may be able to provide a groundwards force of a large enough magnitude for a sufficiently long period of time to adequately mitigate the upward forces generated by the blast shock wave of the explosion.

Figure 3A:
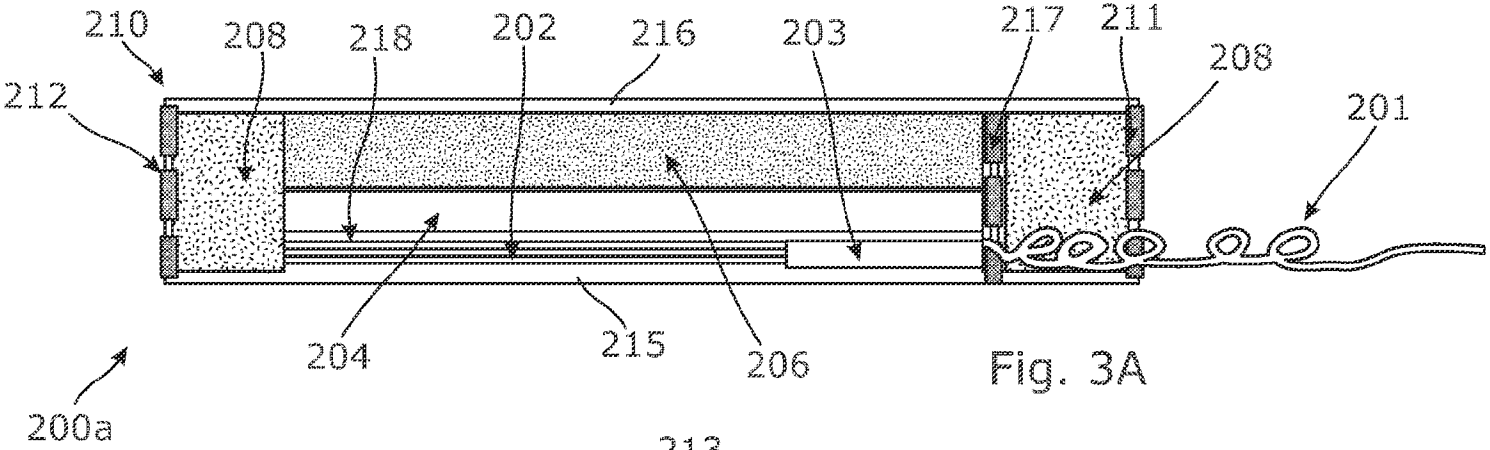
FIGS. 3A and 3B illustrate a vertical cross section and a horizontal cross section respectively of a first example of a blast countermeasure.
Figure 3B:
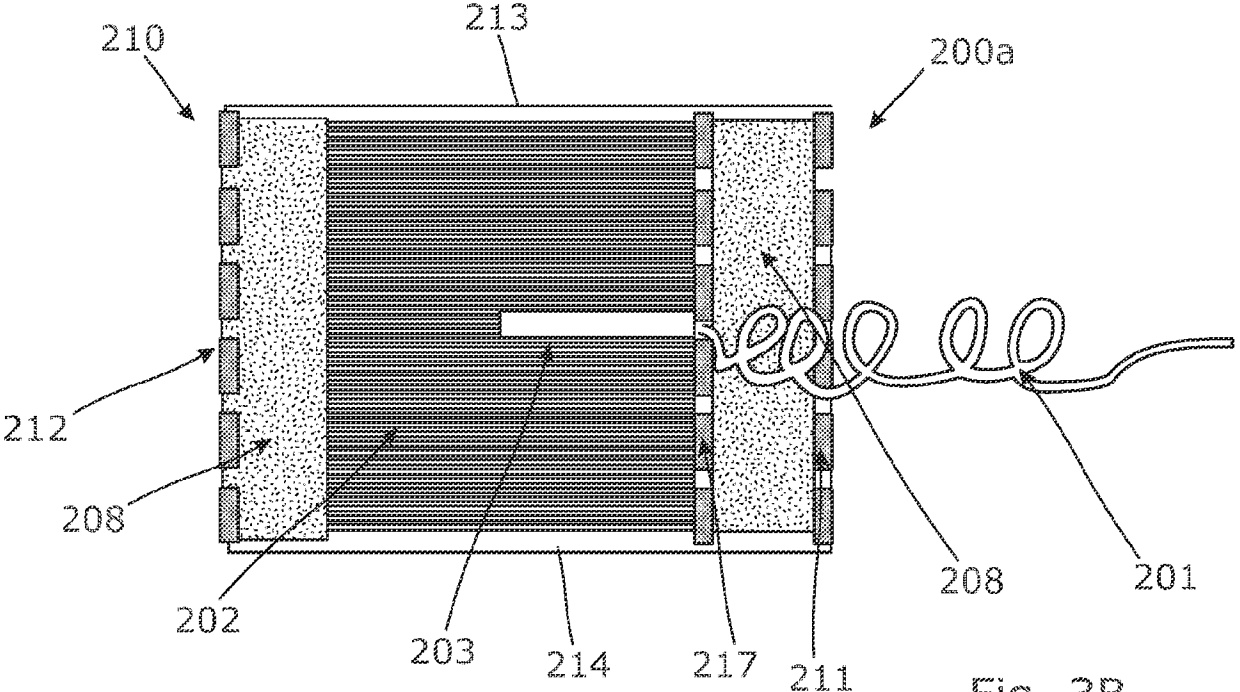

FIGS. 3A and 3B illustrate a vertical cross section and a horizontal cross section respectively of a first example of a blast countermeasure 200*a*. The blast countermeasure 200*a* may be for location between a blast shield of an armoured vehicle and a cabin floor of the armoured vehicle. In this example, the blast countermeasure 200*a* is a cube shape with a square cross section or a rectangular prism shape with a rectangular cross-section.

The blast countermeasure 200*a* comprises a housing 210 which includes a plurality of side walls 211-214, a base (wall) 215, an upper wall/roof 216 and an optional inner wall 217. The blast countermeasure 200 might be a relatively compact device in order to enable it to fit into the space between the cabin floor and the blast shield of an armoured vehicle. For example, the depth of the blast countermeasure 200*a* (in this example, the distance between the base 215 and the upper wall 216), might be less than 150 millimetres, such as less than 100 millimetres. It could, for example, be about 75 millimetres.

The length and the width of the blast countermeasure 200*a* (in this example, the distance between opposing side walls 211, 212 or 213, 214) might be less than 300 millimetres, such as less than 200 millimetres. It could, for example, be about 150 millimetres.

In this example, two of the side walls 211, 212 and the inner wall 217 each include one or more vents. The other side walls 213, 214 might or might not include one or more vents.

The blast countermeasure 200*a* includes at least one explosive 202 which, in this example, is provided by detonating cord and high explosive. In other examples the explosive might consist of solely detonating cord, for example. The blast countermeasure 200*a* includes a detonator 203 for detonating the explosive(s) 202. FIGS. 3A and 3B also illustrate an electrical connector/cable 201 for connecting the detonator 203 to an initiator. The control circuitry 12 is configured to provide an output to the initiator, which, in turn, is configured to provide an output to the detonator 203.

The blast countermeasure 200 further comprises a mass 204, a shock wave attenuator (a first energy absorbing material/means) 206, a further shock wave attenuator (a second energy absorbing material/means) 208 and a reflector 218. The mass 204 is different from the reflector 218 in this example and is formed from one or more solids and might include one or more liquids. In this regard, the mass 204 may be referred to as a "non-gaseous mass".

Each of the shock wave attenuator 206 and the further shock wave attenuator 208 might be formed from one or more resilient, energy absorbing materials such as particulate matter contained within resin. An example of this is the TABRE™ material. The shock wave attenuator 206 and the further shock wave attenuator 208 might each be made from the same material(s), or different materials.

The reflector 218 may be made from one or more metals and may be substantially planar in shape. The reflector 218 is positioned at least partially between the explosive(s) 202 and the mass 204. The purpose of the reflector 218 is to reflect the shock wave, that is generated by detonation of the explosion, groundwards. This increases the magnitude of the downwards force provided by the generated shock wave.

The explosive(s) 202 is/are provided on the base 215 of the illustrated example. For example, detonating cord may be wound in a circular configuration and placed on the base 215. A high explosive might or might not be placed on the detonating cord. The explosive 202 is at least partially located between the mass 204 and the base 215. In some examples, the mass 202 may be suspended within the housing 210 such that there is an air gap between the explosive 202 and the mass 204. In other examples, there might be no such air gap.

The mass 204 is at least partially located between the shock wave attenuator 206 and the explosive 202. In some examples, there may be an air gap between the mass 204 and the shock wave attenuator 206. In other examples, there may be no such air gap.

Figure 3C:
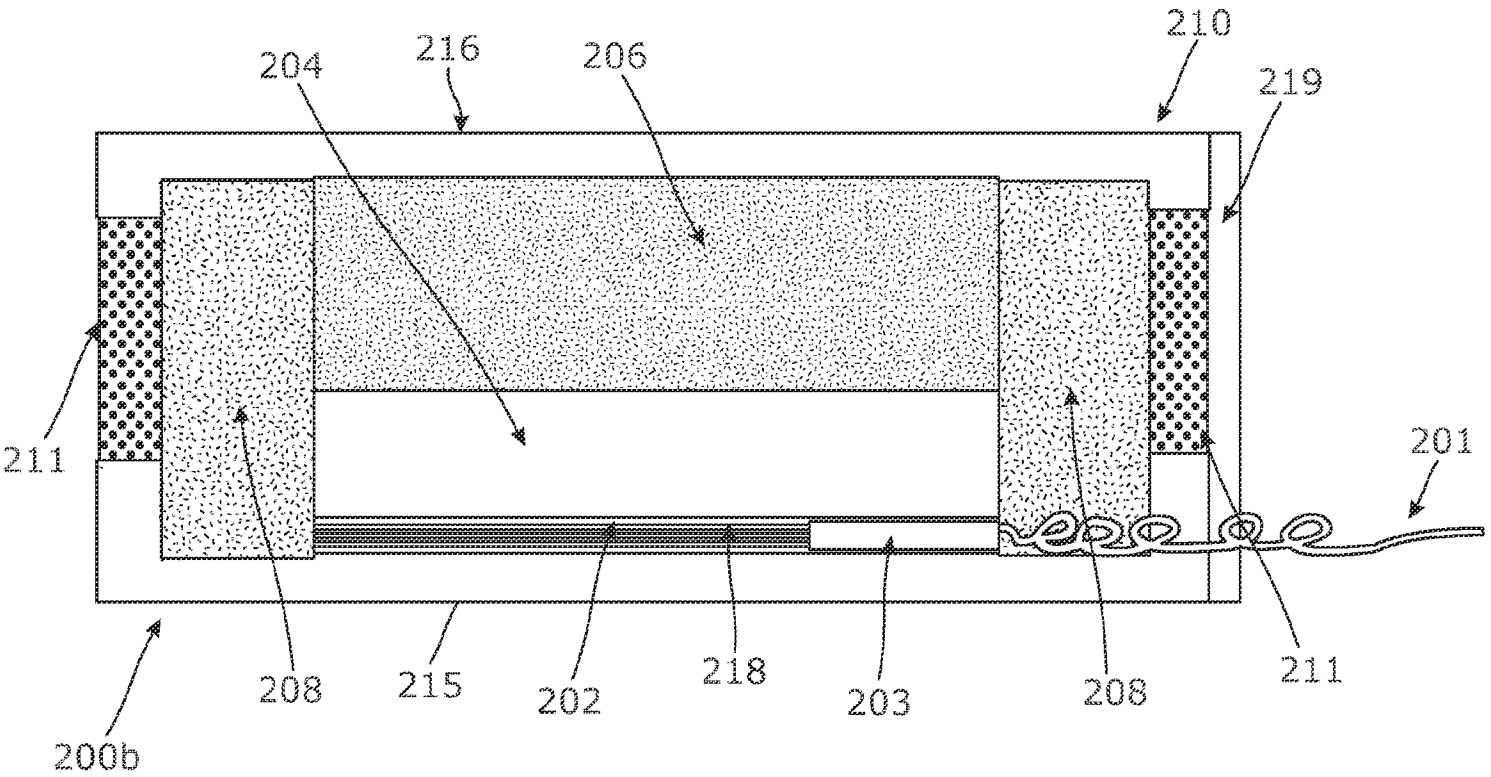
FIG. 3C illustrates a vertical cross section of a second example of a blast countermeasure.

FIG. 3C illustrates a vertical cross-section of a second example of a blast countermeasure 200*b*. The second example of the blast countermeasure 200*b* differs from the first example 200*a* in that it is cylindrical in shape and therefore has a single side wall 211. The single side wall includes a number of vents in the form of perforations in the side wall 211. One or more supports 219 may be provided at intervals around the side wall 211 to help to hold the further shock wave attenuator 208 in position when the explosive 202 is detonated. Corresponding supports 219 might also be present in the FIG. 3A/3B embodiment.

Figure 4:
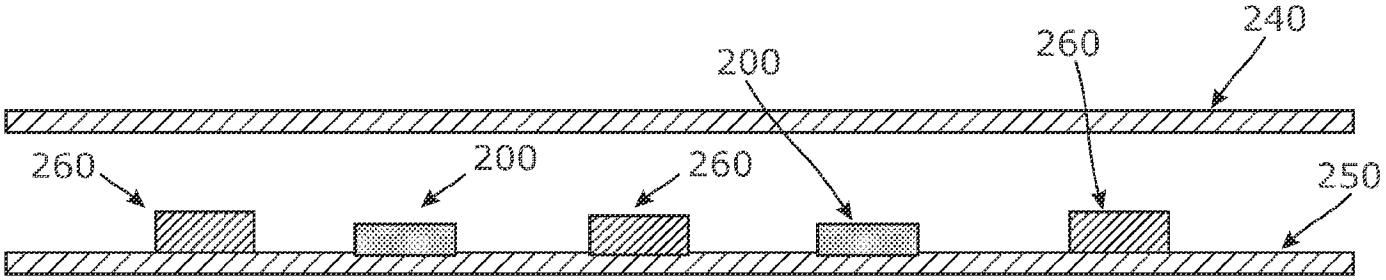
FIG. 4 illustrates a cross section of a first example of an armoured vehicle base which includes blast countermeasures.

FIG. 4 illustrates a cross section of a first example of an armoured vehicle base which includes blast countermeasures 200, such as those 200*a*, 200*b* illustrated in FIGS. 3A, 3B and 3C. The armoured vehicle includes a cabin floor 240 and a blast shield/belly plate 250. The cabin floor 240 may be the floor of the front cabin of the armoured vehicle, the rear cabin of the armoured vehicle or both. That is, the floor 240 is the floor upon which the passengers and/or the driver of the armoured vehicle would place their feet when sitting or standing in the vehicle. The blast shield 250 is located at the underside of the armoured vehicle, underneath the cabin floor 240.

In the example illustrated in FIG. 4, a plurality of elongate strengthening members 260 are provided to strengthen the resistance of the blast shield 250 to an explosion. FIG. 4 shows a cross-section of each elongate strengthening member 260, where the elongate length of each member 260 is directed into and out of the page. The dimension directed into and out of the page in FIG. 4 might be the widthwise dimension of the armoured vehicle.

The elongate strengthening members 260 might be formed, at least in part, from a composite material such as carbon fibre. The blast shield 250 and/or the elongate strengthening members 260 may take the same form as those disclosed in PCT patent application publication number WO 2019/030465, for example.

In FIG. 4, each of the blast countermeasures 200 is positioned on an upper surface of the blast shield 250, and is located between the cabin floor 240 and the blast shield 250. That is, the base 215 of each of the blast countermeasures 200 is positioned on the blast shield 250. Each of the blast countermeasures 200 is located between the cabin floor 240 and the blast shield 250 in a first, vertical, dimension.

If the armoured vehicle comprises elongate strengthening members 260, at least some of the blast countermeasures 200 may be positioned in between adjacent (first and second) elongate strengthening members, as shown in FIG. 4.

In some implementations, each of the blast countermeasures 200, 200*a*, 200*b* might not have the same configuration as in FIGS. 3A to 3C in which each of the blast countermeasures 200, 200*a*, 200*b* has its own roof/upper wall 216, its own reflector 218 and/or its own shock wave attenuator 206. For example, instead, the upper wall 216, the reflector 218 and/or the shock wave attenuator 206 might extend across multiple blast countermeasures 200, 200*a*, 200*b*, between the cabin floor 240 and the blast countermeasures 200, 200*a*, 200*b*.

Figure 5:
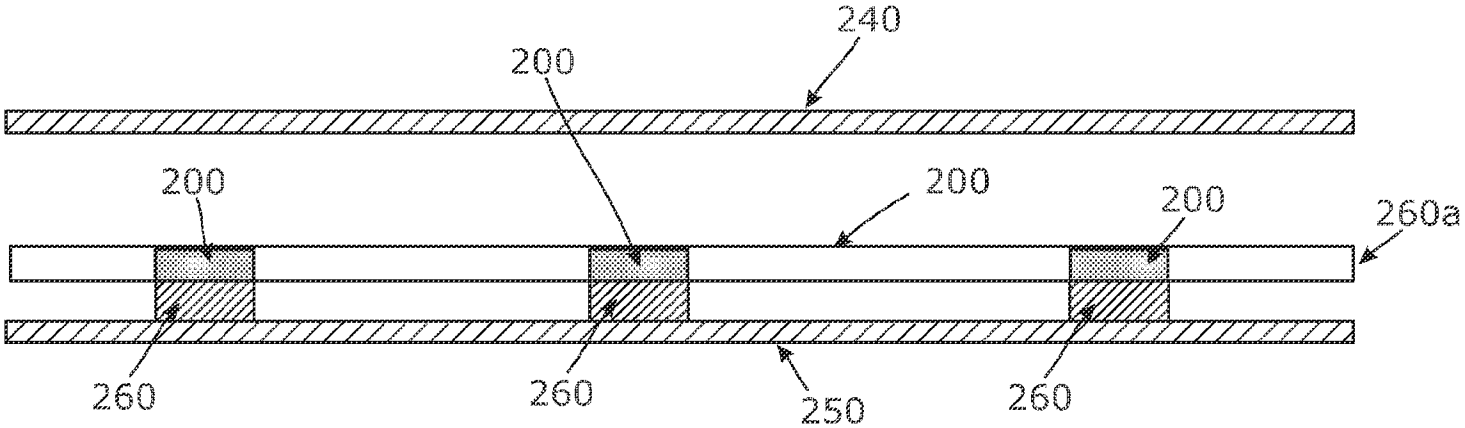
FIG. 5 illustrates a cross section of a second example of an armoured vehicle base which includes blast countermeasures.

FIG. 5 illustrates a cross-section of a second example of an armoured vehicle base which includes blast countermeasures 200. The blast countermeasures 200 may be the same as those illustrated in FIGS. 3A to 3C. The example in FIG. 5 differs from the example in FIG. 4 in that at least one longitudinal elongate strengthening member 260*a* is provided in addition to the widthwise elongate strengthening members 260. The length of the longitudinal elongate strengthening member(s) 260*a* is/are substantially perpendicular to the length of the widthwise elongate strengthening members 260.

Figure 6:
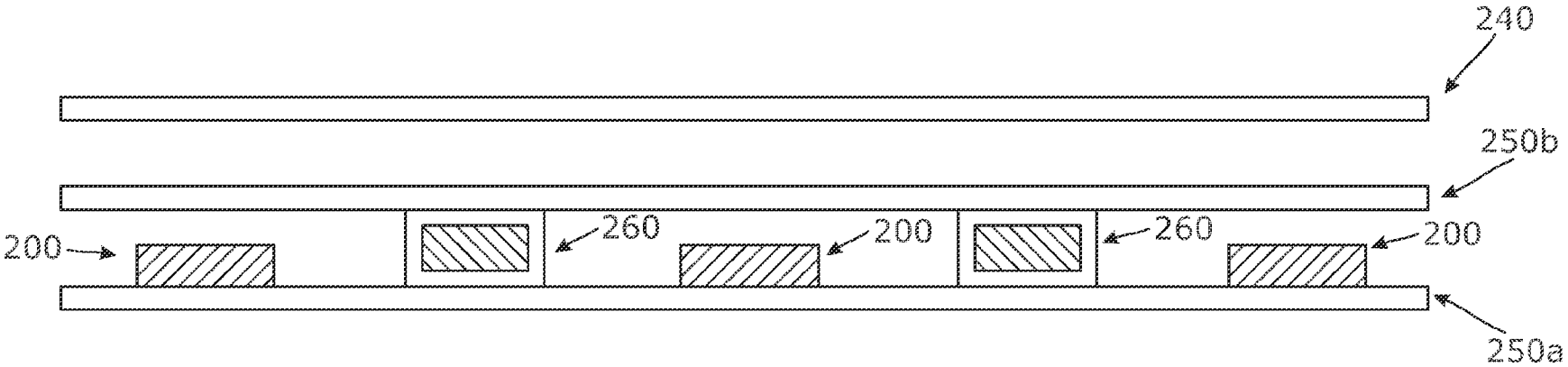
FIG. 6 illustrates a cross-section of a third example of an armoured vehicle base which includes blast countermeasures.

In each of the examples illustrated in FIGS. 4 and 5, the armoured vehicle base might comprise a further blast shield that is located, at least in part, between the cabin floor 240 and the blast countermeasures 200. FIG. 6 illustrates such an instance, in which a second blast shield 250*b* has been added to the example illustrated in FIG. 4. The first blast shield 250*a* is located at the underside of the vehicle. The second blast shield 250*a* is located, at least in part, between the cabin floor 240 and the blast countermeasures 200. The (upper) second blast shield 250*b* might be attached to the elongate strengthening members 260, forming a sandwich structure with the (lower) first blast shield 250*a*.

In use, when an explosion local to (and external to) the armoured vehicle occurs (for example, a mine or an IED blast), it is initially detected by the detectors 18. The control circuitry 12 receives the inputs from the detectors 18 and determines how to respond to the inputs by referring to the response data 16. The control circuitry 12 then provides outputs to activate the blast countermeasures 200 based on the response data 16. For example, the response data 16 might indicate which blast countermeasures 200 to activate in particular circumstances, depending upon, for example, the magnitude and directivity of the blast shock wave.

The outputs provided by the control circuitry 12 activate one, some or all of the blast countermeasures 200, causing the detonator 203 to detonate the explosive 202. Detonation of the explosive 202 generates an omnidirectional shock wave within the housing 210. The force generated by the detonation of the explosive 202 produces the shock wave which is at least partially reflected groundwards by the reflector 218. The shock wave also urges the mass 204 upwards, which in turn generates a reactionary groundwards/downwards force on the reflector 218 that is transmitted through to the base 215 of the blast countermeasure 200.

Due to conservation of momentum, the groundwards impulse that is generated by detonation of the explosive is thought to be equal to the upwards impulse that is generated by detonation of the explosive 202. However, the nature of the impulses is different. The shock wave attenuator 206 slows down the shock wave generated by the explosion when the shock wave is travelling in an upwards direction. High pressure gas is also generated by detonation of the explosive, which generates pressure within the housing 210. The shock wave attenuator 206 also slows down the upwards movement of the reflector 218 and mass 204 that occurs in response to the shock wave and the generated gas pressure, due to the positioning of the shock wave attenuator 206 above the explosive 202, the reflector 218 and the mass 204. The shock wave attenuator 206 is a crushable material which crushes under the upwards force applied by the reflector 218 and the mass 204. The slowing down of the shock wave, the mass 204 and the reflector 218 in an upwards direction reduces the magnitude of the upwards force that is generated, causing it to be applied to the vehicle over a greater period of time than the downwards force. This is illustrated schematically in FIG. 1B, which illustrates a first, groundwards force 31 that is applied to the vehicle by a blast countermeasure 200 and a second, upwards force 32 that is applied to the vehicle by the blast countermeasure 200.

The reflected shock wave and the reactionary force (provided by urging the mass 204 upwards) act on the (lowermost) blast shield 250, providing a high magnitude, short duration groundwards force that counteracts the upwards force generated by the mine or IED blast local to the vehicle, mitigating or preventing the upwards acceleration of the armoured vehicle into the air and maintaining the vehicle upright and in fighting condition.

Absorption of the portion of shock wave that is directed upwards by the shock wave attenuator 206 helps to prevent the explosion which occurs within the housing 210 of the blast countermeasure 200 from having an adverse impact on the cabin floor 240. Depending on the nature of the blast countermeasure 200 and the forces generated by it, it might be advantageous to have an upper blast shield 250*b* (as illustrated in FIG. 6) to protect the cabin floor 240 and the occupants of the cabin against the portion of shock wave that is directed upwards towards the cabin floor 240.

The portion of the shock wave that is directed in the horizontal dimension is attenuated, at least in part, by the further shock wave attenuator 208. The vents provided in the side wall(s) 211, 212 are arranged to relieve pressure which is generated within the housing by detonation of the explosive 202.

The blast countermeasures 200 may be activated simultaneously or sequentially in order to provide a groundwards impulse that appropriately mitigates the upward force generated by the explosion local to the vehicle.

Figure 7A:
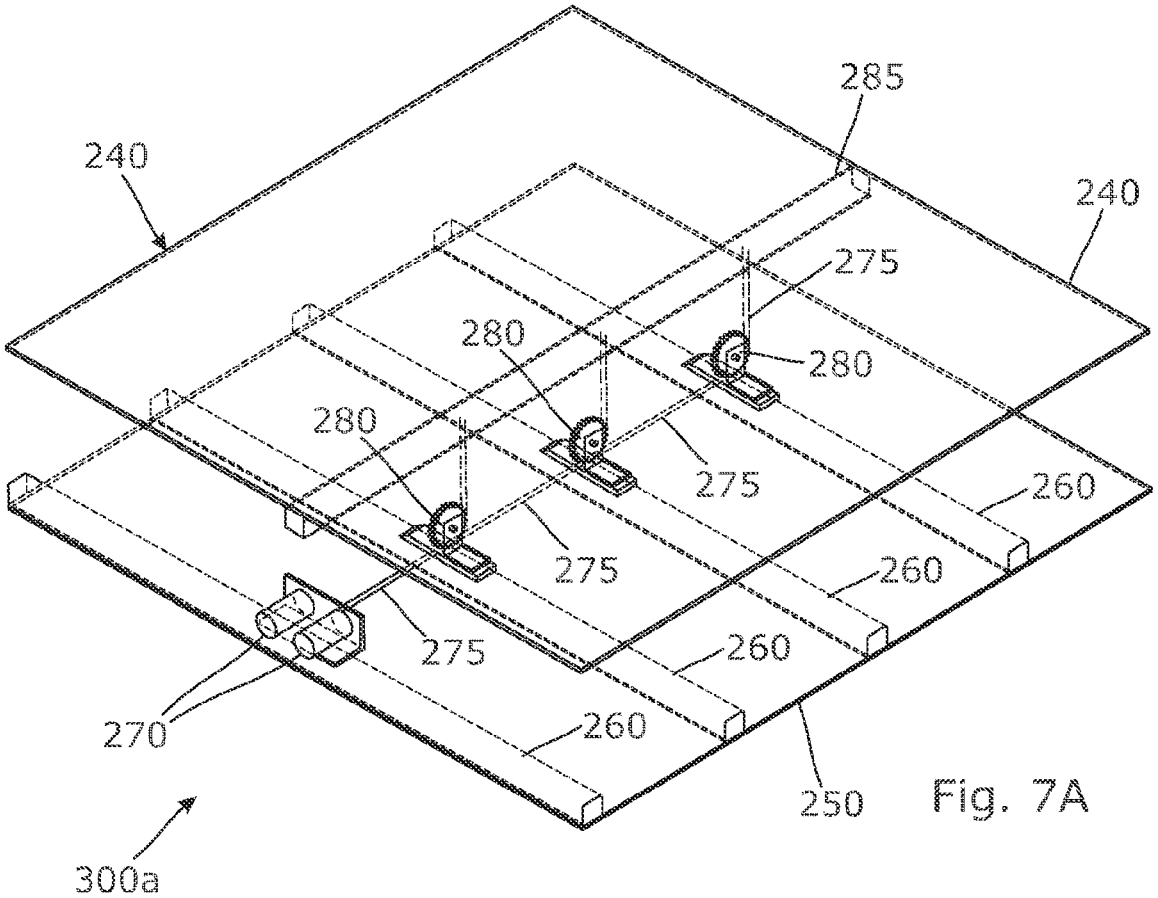
FIG. 7A illustrates a perspective view of a floor retraction mechanism for an armoured vehicle.
Figure 7B:
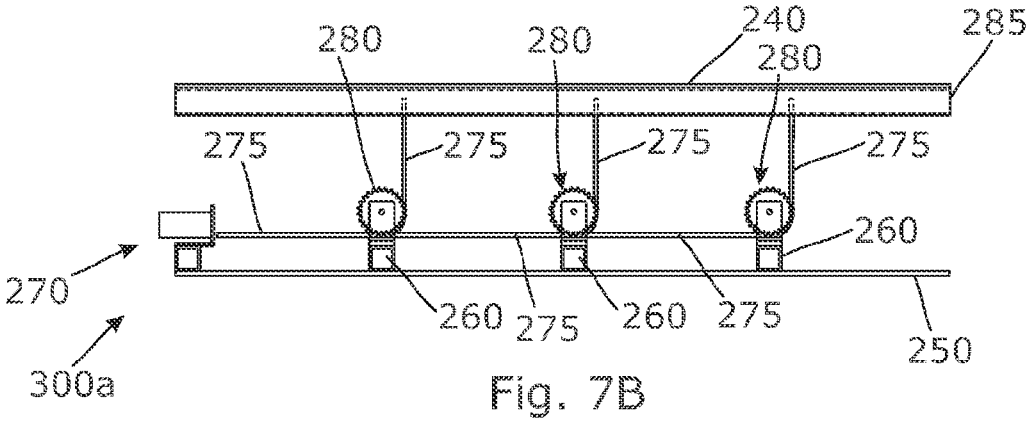
FIG. 7B illustrates a side view of the floor retraction mechanism of FIG. 7A.
Figure 7C:
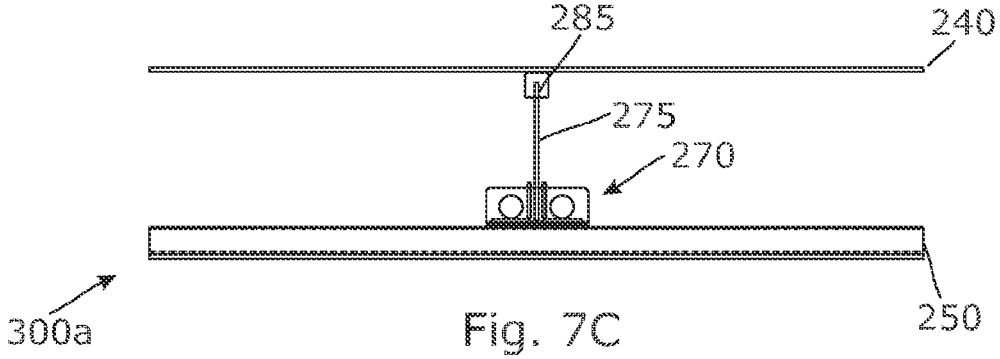
FIG. 7C illustrates an end view of the floor retraction mechanism of FIGS. 7A and 7B.

FIG. 7A illustrates a perspective view of a first example 300*a* of a floor retraction mechanism 300. This example may be appropriate for use in a rear cabin of an armoured vehicle, for instance, in which passengers are carried. FIGS. 7B and 7C illustrate side and end views respectively of the floor retraction mechanism 300*a* illustrated in FIG. 7A. In the illustrated example, a plurality of elongate strengthening members 260 are provided on the blast shield 250, as described above in relation to FIG. 3.

The floor retraction mechanism 300*a* comprises at least one actuator 270, which is coupled to the cabin floor 240, for generating a force that causes at least a portion of the cabin floor to be pulled groundwards.

In this example, the actuator 270 is coupled to the cabin floor 240 using at least one tractor 275, one or more pulleys 280 and an elongate connecting member 285. The tractor(s) 275 might comprise one or more chains and/or one or more cables. In other examples, the tractor(s) 275 might be one or more rods. The tractor 275 is coupled to the actuator 270 (such as directly connected to the actuator 270) and routed from the actuator 270, through the one or more pulleys 280 to the elongate connecting member 285. The elongate connecting member 285 is optional and potentially enables a pulling force to be more uniformly applied along or across the cabin floor 240. In the illustrated example, the tractor 275 is connected/coupled to the underside of the cabin floor 240 via the elongate connecting member 285.

The actuator 270 is an explosively driven actuator. That is, an explosion within the actuator 270 generates a force. In some implementations, the actuator 270 might be configured to receive (or comprise) multiple explosive cartridges, where each explosive cartridge enables a force to be generated to cause a portion of the cabin floor 240 to be pulled groundwards on a separate occasion. This advantageously enables the floor actuation mechanism 300*a* to be activated/fired on several separate occasions.

In use, when an explosion occurs local to the armoured vehicle, the explosion is detected by the detectors 18. The control circuitry 12 receives inputs from the detectors and responds by sending an output which causes the actuator 270 to actuate. Actuation of the actuator 270 generates a force which causes at least a portion of the cabin floor 240 to be pulled groundwards. In this instance, when the actuator 270 actuates, it causes the actuator 270 to pull the tractor 275 through the one or more pulleys 280, increasing the tension in the tractor 275 and pulling at least a portion of the cabin floor 240 groundwards.

In some examples, the whole of the cabin floor 240 is able to move and is pulled groundwards. In other examples, only a portion of the cabin floor 240 is configured to move groundwards. For example, the cabin floor 240 might be partially fixed within the vehicle and might flex when it is pulled groundwards. The cabin floor 240 might be fixedly positioned within the armoured vehicle along at least a portion of the periphery of the cabin floor 240. The portion of the cabin floor 240 that is pulled groundwards might be located away from the periphery of the cabin floor 240 and might, for example, be at or close to the centre of the cabin floor 240. The cabin floor 240 might automatically return to its original position a period of time after the actuator 270 was actuated. For example, the cabin floor 240 might be resilient in nature and might "spring" back into its original position.

Advantageously, groundwards movement of the cabin floor 240 in response to the detection of an explosion may mitigate or prevent damage to the feet of personnel situated within the vehicle when the explosion occurs. For example, the blast shock wave generated by an explosion local to a vehicle, such as underneath a vehicle, might be transmitted through a vehicle to the cabin floor 240 such that the cabin floor 240 begins to vibrate vigorously at high speed. By de-coupling the vibrating cabin floor 240 from the feet of those inside, injury is mitigated or prevented.

The floor retraction mechanism 300*a* need not have the same configuration as that illustrated in FIGS. 7A, 7B and 7C. Instead, for example, of the actuator(s) 270 pulling the tractor(s) 275 horizontally in the manner illustrated in those figures, the actuator 270(s) might pull the tractor(s) 275 directly groundwards/downwards.

Figure 8A:
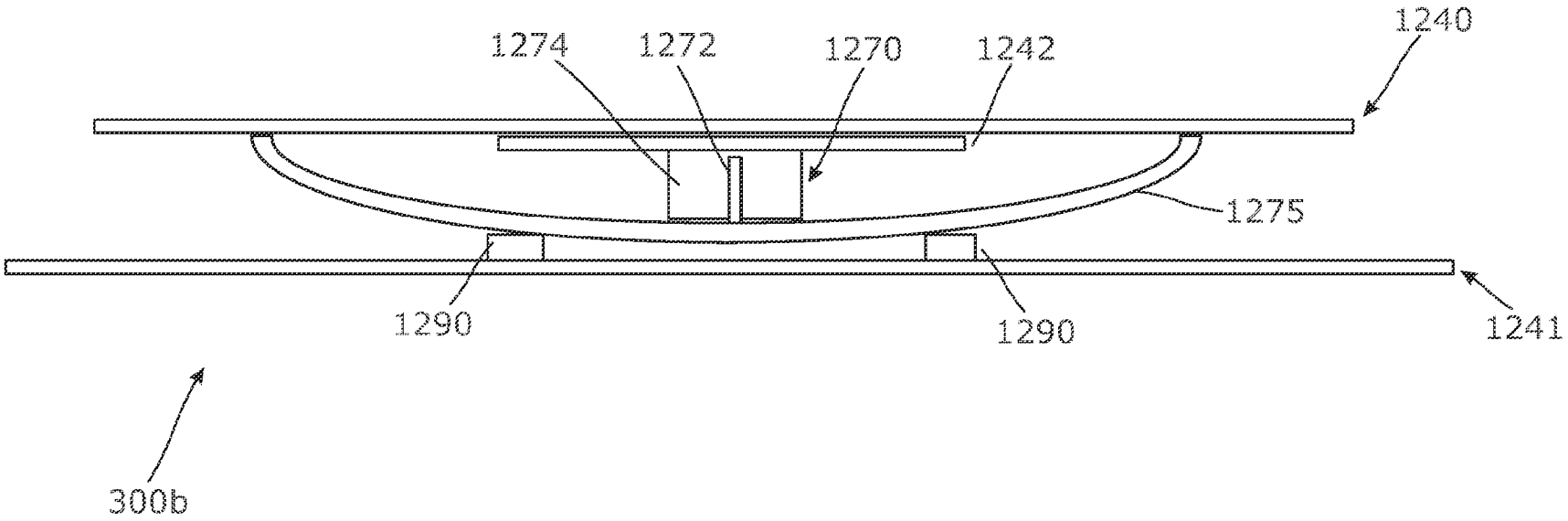
FIG. 8A illustrates a cross section of a further floor retraction mechanism for an armoured vehicle.
Figure 8B:
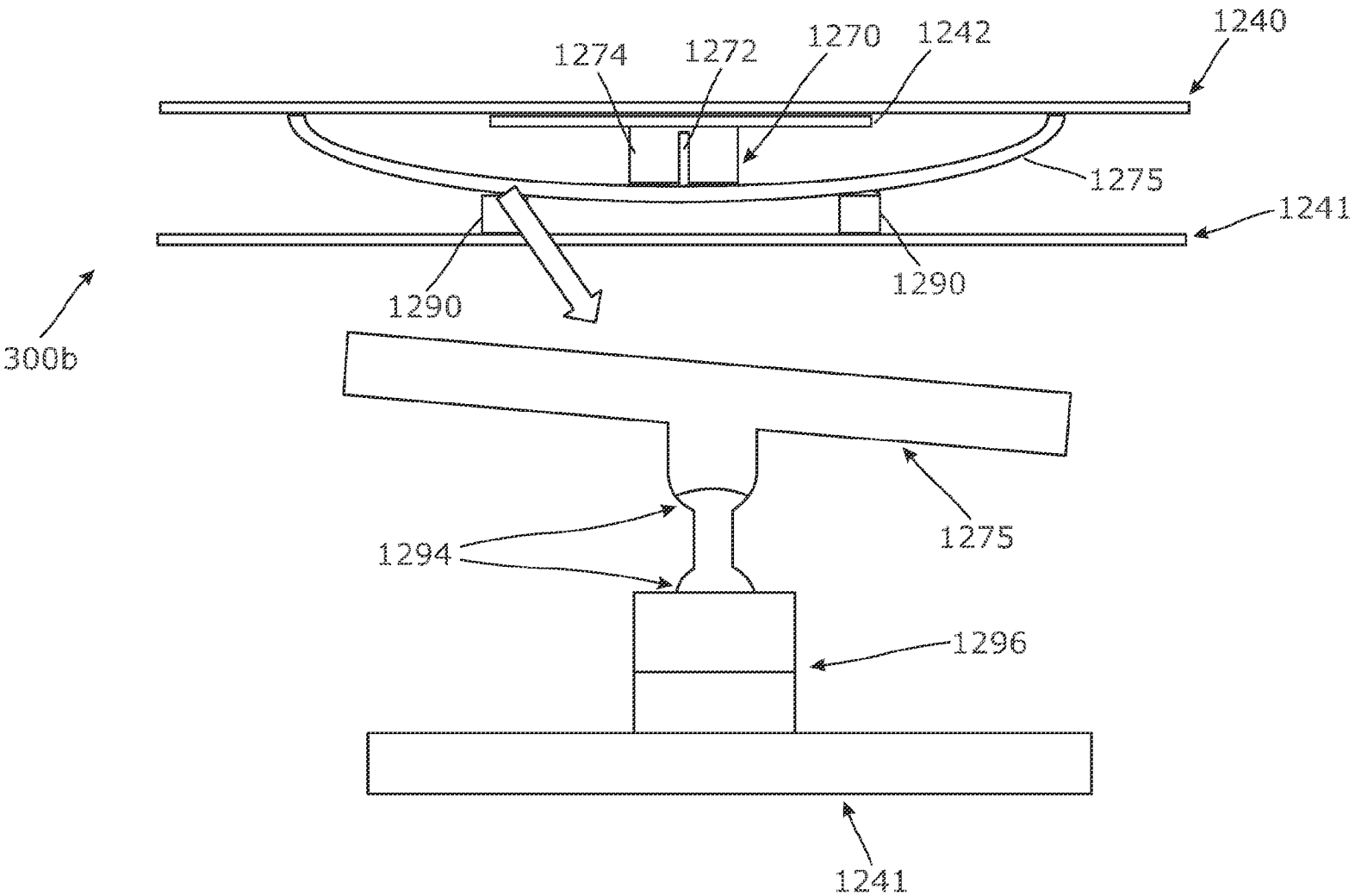
FIG. 8B illustrates a detailed cross-sectional view of a mount of the further floor retraction mechanism illustrated in FIG. 8A.

FIGS. 8A and 8B illustrate a second example 300*b* of the floor retraction mechanism 300. The second example of the floor retraction mechanism 300*b* might, for example, be suitable for use in a front cabin of an armoured vehicle in which the driver of the armoured vehicle may be located. The armoured vehicle includes a cabin floor 1240 and a lower surface 1241. The lower surface 1241 might be the original cabin floor 1241 in the vehicle and the cabin floor 1240 might be a new, replacement cabin floor. The cabin floor 1240 has a reinforcement 1242. An actuator 1270 is provided for causing the cabin floor 1240 to be pulled groundwards. The actuator 1270 is coupled to the cabin floor 1240 via the reinforcement 1242.

One or more tractors 1275 are provided couples the actuator 1270 to the cabin floor 1240. In this example, the tractor(s) 275 might be provided by at least one Belleville spring or a leaf spring arrangement, for example. The tractor/spring 1275 is coupled to the lower surface 1241 by one or more mounts 1290.

FIG. 8B illustrates a mount 1290 in more detail. The mount 1290 may include one or more joints 1294, such as twin spherical joints or twin single axis hinges to enable the spring 1275 to move to retract the cabin floor 1240.

In this example the actuator 1270 includes a detonator 1272 contained within a separator 1274. The separator 1274 might be a ceramic block. The separator 1274 separates the spring 1275 from the cabin floor 1240 and holds/maintains the spring 1275 in a pre-tensioned configuration. The actuator 1270 is actuated by detonating the detonator 1264, which causes the separator 1274 to cease holding the spring 1275 in its pre-tensioned configuration. In this example, detonation of the detonator 1262 causes the separator 1274 to disintegrate. Without the presence of the separator 1274, the tension in the spring 1275 causes the spring 1275 pulls the cabin floor 1240 groundwards (whilst the connection between the spring 1275 and the lower surface 1241 is maintained by the mounts 1290).

Figure 9:
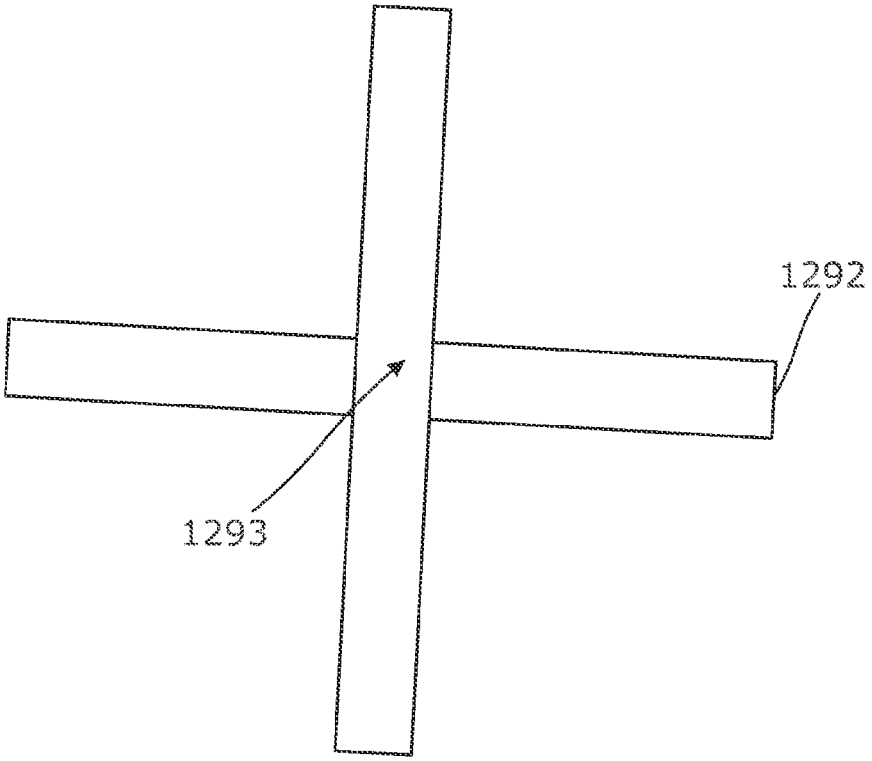
FIG. 9 illustrates a leaf spring arrangement for use in the further floor retraction mechanism illustrated in FIGS. 8A and 8B.

FIG. 9 illustrates a leaf spring arrangement that may be suitable for use as the tractor/spring 1275 in the example illustrated in FIGS. 8A and 8B. The leaf spring arrangement comprising a first spring 1292 and a second leaf spring 1293, which crosses the first leaf spring 1292.

Figure 10:
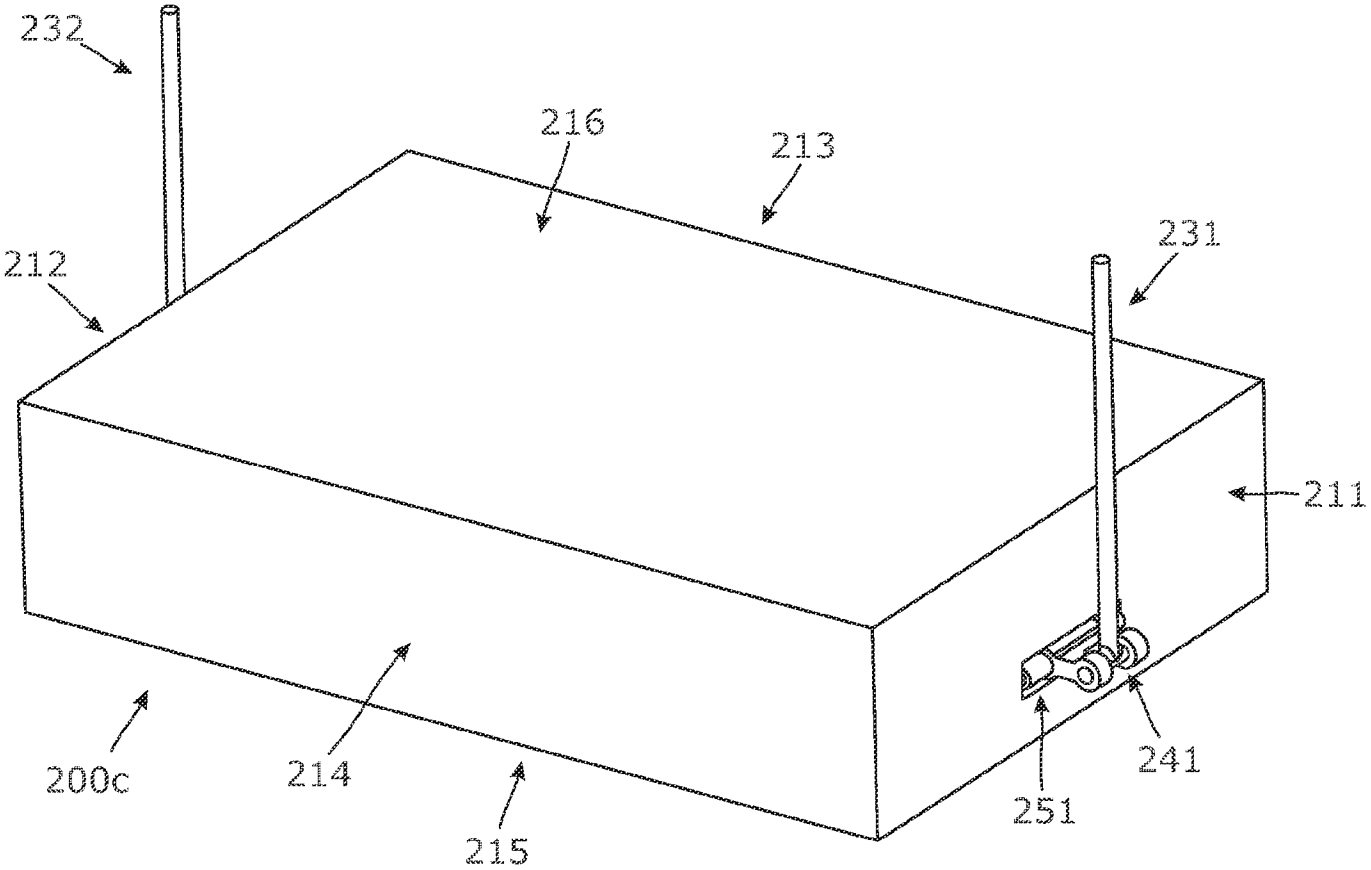
FIG. 10 illustrates a perspective view of a third example of a blast countermeasure.
Figure 11:
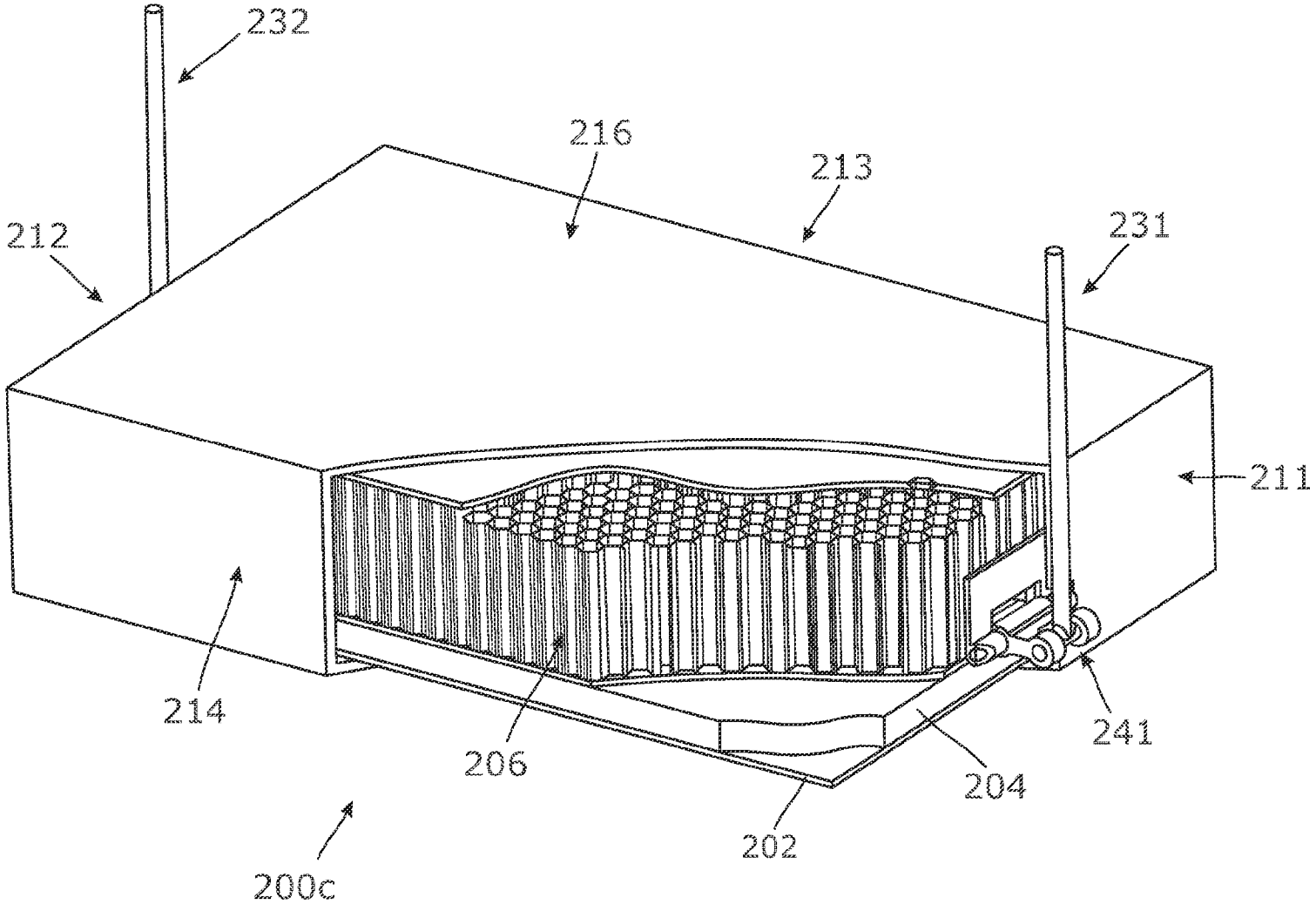
FIG. 11 illustrates a perspective view of the third example of the blast countermeasure with part of its housing cutaway.

FIG. 10 illustrates a perspective view of a third example of a blast countermeasure 200*c*. FIG. 11 illustrates a perspective view of the third example of the blast countermeasure 200*c* with part of its housing 210 cutaway.

The illustrated blast countermeasure 200*c* is a rectangular prism shape with a rectangular cross-section, but in other implementations it might be different shape, such as a cube shape with a square cross-section or cylindrical shape with a circular cross-section.

The third example of the blast countermeasure 200*c* is similar to the first and second examples of the blast countermeasure 200*a*, 200*b* in that it comprises a housing 210, at least one explosive 202, a detonator for detonating the explosive, a mass 204 and a shock wave attenuator 206.

The housing 210 includes at least one wall 211-216 in the form of a plurality of side walls 211-214, a base (wall) 215 and an upper wall/roof 216. The third example of the blast countermeasure 200*c* might be a relatively compact device in order to enable it to fit into the space between the adjacent blast shields 250*a*, 250*b* in the base of an armoured vehicle, as described above in relation to FIG. 6. For example, the depth of the blast countermeasure 200*c* (in this example, the distance between the base 215 and the upper wall 216), might be less than 150 millimetres, such as less than 100 millimetres. It could, for example, be about 75 millimetres.

The length and the width of the blast countermeasure 200*a* (in this example, the distance between opposing side walls 211, 212 or 213, 214) might be less than 300 millimetres, such as less than 200 millimetres. It could, for example, be about 150 millimetres. One, some or all of the walls 211-216 might each include one or more vents.

In this example, the explosive 202 is sheet explosive, although that need not be the case in every implementation. The sheet explosive may be formed, at least in part, from high explosive. The explosive 202 may be detonated by a detonator. The control circuitry 12 of the vehicle protection apparatus 1000 is configured to provide an output to an initiator, which is in turn configured to provide an output to the detonator.

In the third example of the blast countermeasure 200*c*, a separate reflector is not provided. Instead, a lower surface of the mass 204 acts to reflect the shock wave produced by detonation of the explosive 202. The mass 204 may be formed from one or more solids and might include one or more liquids. In this regard, the mass 204 may be referred to as a "non-gaseous mass". In the illustrated example, the mass 204 is formed from steel.

The shock wave attenuator 206 in the illustrated example is formed from one or more metals, such as steel or aluminium and has a honeycomb structure. Alternatively, as explained above in relation to the first example of the blast countermeasure 200*a*, it might be formed from particulate matter contained within resin such as the TABRE™ material.

The explosive(s) 202 is/are provided on the base 215 of the illustrated example. The mass 204 is at least partially located between the shock wave attenuator 206 and the explosive 202. In some examples, there may be an air gap between the mass 204 and the shock wave attenuator 206. In other examples, there may be no such air gap.

The third example of the blast countermeasure 200*c* functions in a similar manner to the first and second examples 200*a*, 200*b* described above. A force generated by detonation of the explosive 202 produces an omnidirectional shock wave which is at least partially reflected groundwards by the mass 204. The shock wave and the gas pressure that results from the detonation of the explosive 202 also urges the mass 204 upwards, which in turn generates a reactionary groundwards/downwards force that is transmitted through to the base 215 of the blast countermeasure 200*c*.

As explained above, the shock wave attenuator 206 slows down the shock wave generated by the explosion and slows down the mass 204 as the mass 204 crushes the shock wave attenuator 206, when the shock wave and the mass 204 are travelling in an upwards direction, due to its positioning above the explosive 202. This reduces the magnitude of the upwards force that is generated, causing it to be applied to the vehicle over a greater period of time than the downwards force. This is illustrated schematically in FIG. 1B, which illustrates a first, groundwards force 31 that is applied to the vehicle by a blast countermeasure 200 and a second, upwards force 32 that is applied to the vehicle by the blast countermeasure 200*c*.

The reflected shock wave and the reactionary force (provided by urging the mass 204 upwards) act on a (lowermost) blast shield 250*a* of the vehicle, providing a high magnitude, short duration groundwards force that counteracts the upwards force generated by the mine or IED blast local to the vehicle, mitigating or preventing the upwards acceleration of the armoured vehicle into the air and maintaining the vehicle upright and in fighting condition. The conversion of (i) the kinetic energy of the shock wave and the mass 204 and (ii) the gas pressure generated by the detonation of the explosive 202 into (iii) deformation of the shock wave attenuator 206 helps to prevent the explosion which occurs within the housing 210 of the blast countermeasure 200 from having an adverse impact on the cabin floor 240 of the armoured vehicle.

An upper blast shield 250*b* (as illustrated in FIG. 6) to protect the cabin floor 240 and the occupants of the cabin against upward forces generated by the portion of shock wave that is directed upwards may be provided.

The third example of the blast countermeasure 200*c* may also configured such that detonation of the explosive 202 causes the blast countermeasure 200*c* to pull the cabin floor 240 groundwards. In effect, the blast countermeasure 200*c* combines the functionality of the blast countermeasures 200*a*, 200*b* described above and that of the actuator 270 of the floor retraction mechanism 300*a* described above. The third example of the blast countermeasure 200*c* is an example of an explosively driven actuator.

The third example of the blast countermeasure 200*c* may be coupled to the cabin floor 240 of an armoured vehicle such that activation of the blast countermeasure 200*c* causes the cabin floor to be pulled groundwards. In this regard, the third example of the blast countermeasure 200*c* may further comprise coupling means in the form of one or more levers 231, 232 that are arranged to couple the blast countermeasure 200*c* to the cabin floor 240. If the armoured vehicle has an upper blast shield 250*b*, such as that illustrated in FIG. 6, the one or more levers 231, 232 may be routed through the upper blast shield 250*b* to the cabin floor 240, or otherwise coupled to the cabin floor 240.

In the example illustrated in FIG. 10, a plurality of levers 231, 232 are provided. Each lever extends through an aperture 251 in the housing 10 and is positioned, in part, between the mass 204 and the shock wave attenuator 206. A portion of each lever 231, 232 is positioned on a portion of an upper surface of the mass 204. Each lever 231, 232 comprises a hinge 241, about which the lever 231, 232 is configured to pivot.

Detonation of the explosive 202 causes an upwards force to be applied to the mass 204, which in turn applies an upwards force to the portion of each lever 231, 232 that is positioned on the mass 204. This causes the levers 231, 232 to pivot about the hinges 241 and pull the cabin floor 240 groundwards.

The detonation of the explosive 202 therefore causes the blast countermeasure 200*c* to apply the groundwards force to the blast shield 250*a* and pull the cabin floor 240 groundwards substantially simultaneously.

Figure 12:
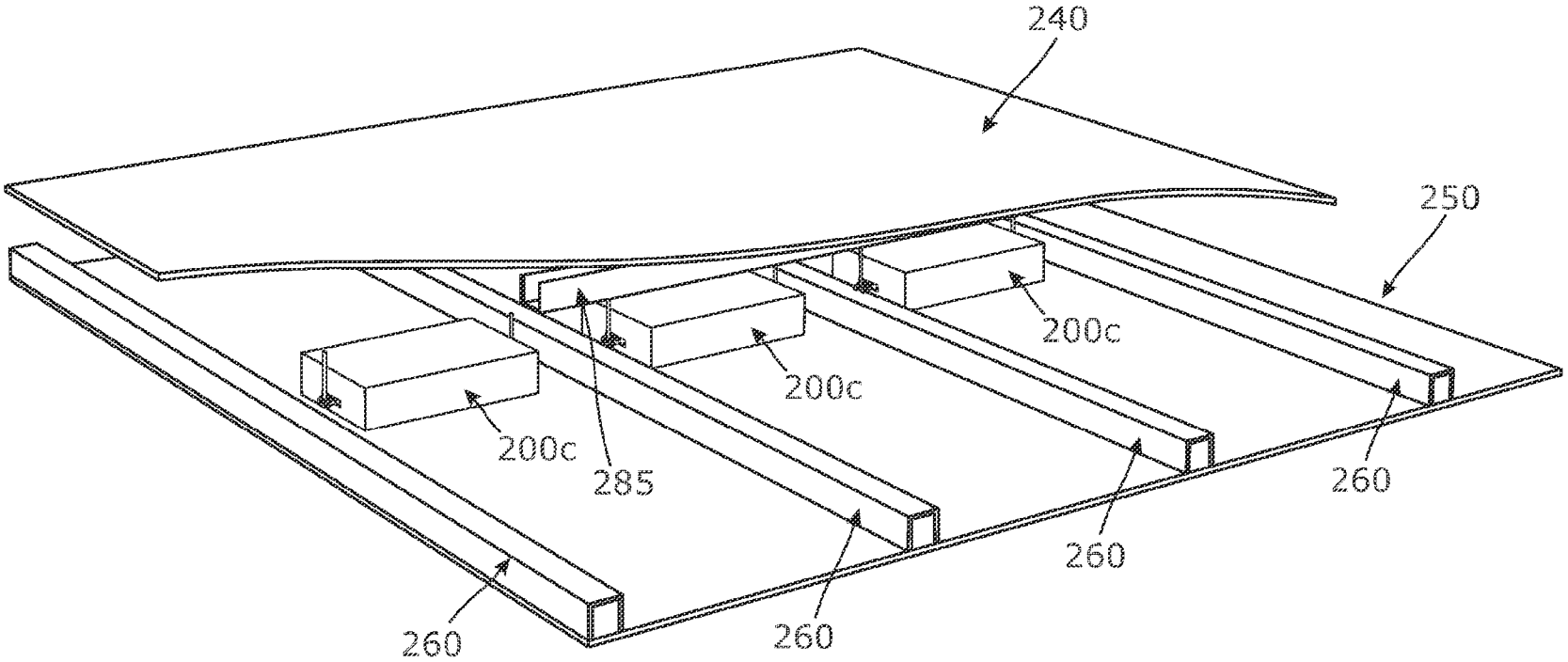
FIG. 12 illustrates a perspective view of a base of an armoured vehicle that includes blast countermeasures.

FIG. 12 illustrates a perspective view of the base of an armoured vehicle that includes the blast countermeasures 200*c*. The base illustrated in FIG. 12 is similar to that illustrated in FIG. 6, but differs in that no upper blast shield 250*b* is shown for clarity purposes. Such an upper blast shield 250*b* might or might not be present.

The vehicle base illustrated in FIG. 12 is shown to include an optional elongate connecting member 285, which is similar to that described above in relation to FIGS. 7A to 7C. In the illustrated example, the levers 231, 232 of each blast countermeasure 200*c* are connected to the elongate connecting member 285 that is in turn connected to the cabin floor 240. One or more intermediate connecting members could exist between the levers 231, 232 and the elongate connecting member 285, and/or between the elongate connecting member 285 and the cabin floor 240.

Figure 13:
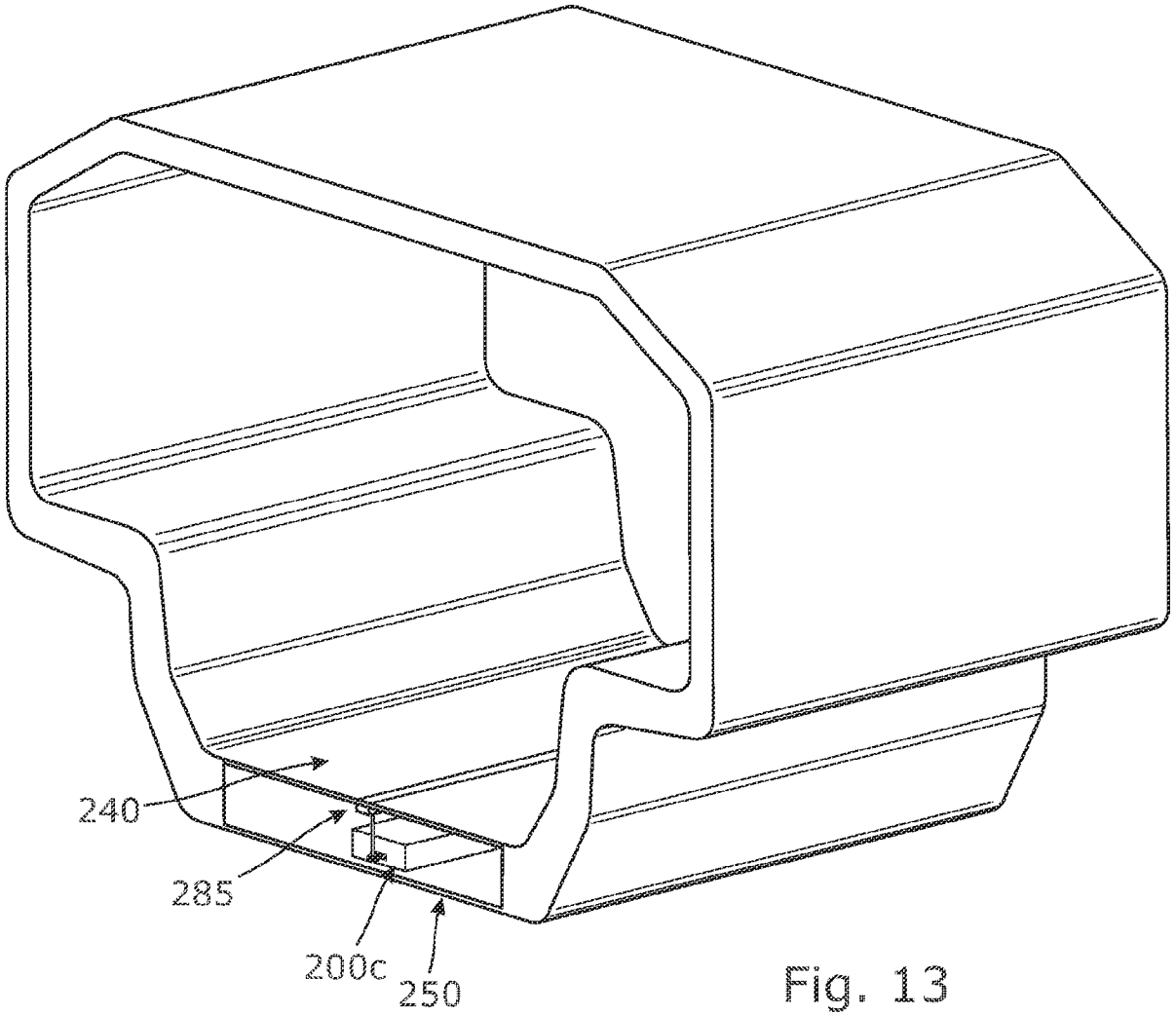
FIG. 13 illustrates a perspective view of a partial vehicle body that includes the base illustrated in FIG. 12.
Figure 14:
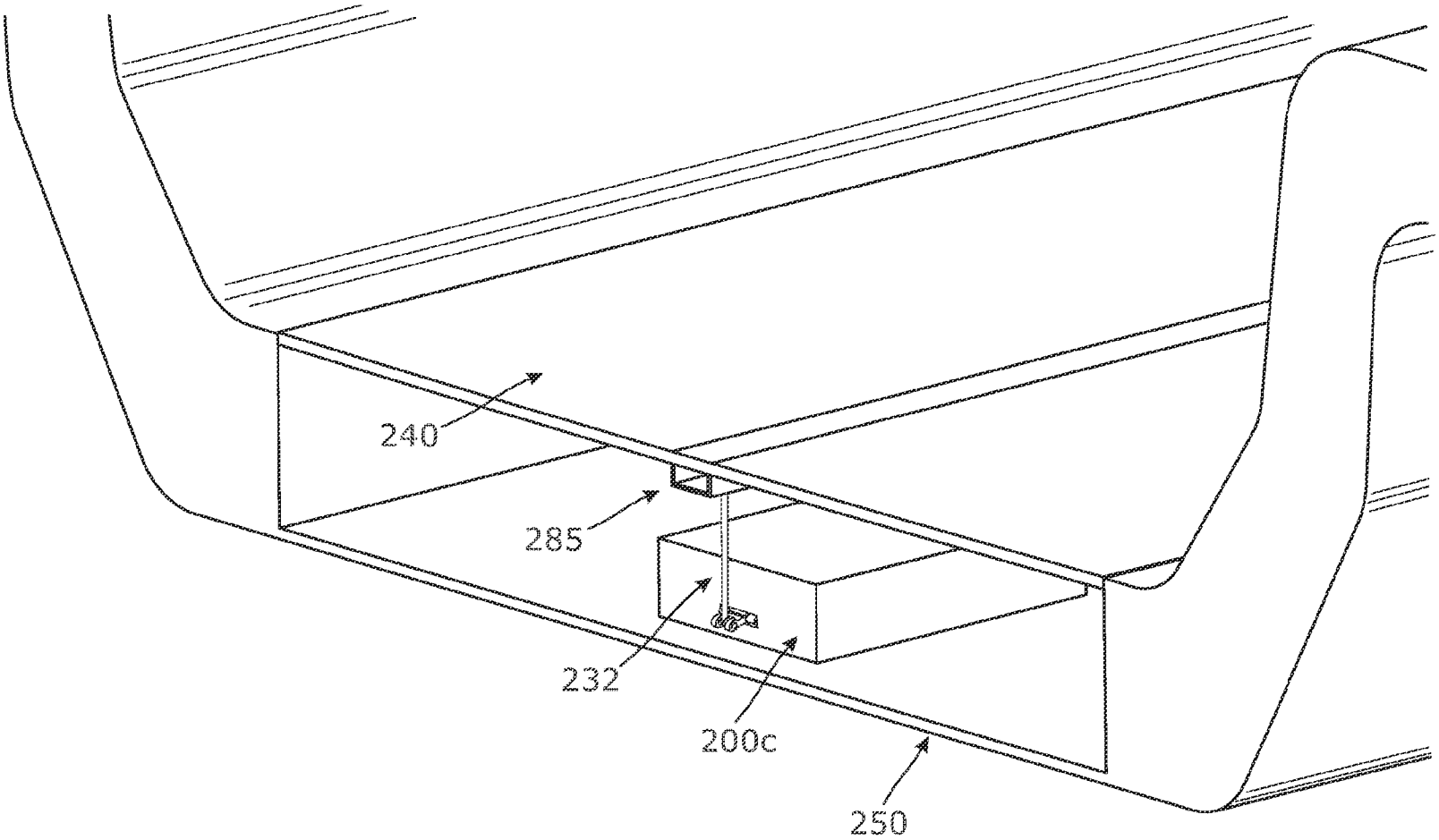
FIG. 14 illustrates a close up of the base of the partial vehicle body illustrated in FIG. 13.

FIG. 13 illustrates a perspective view of a partial vehicle body that includes the base illustrated in FIG. 12. FIG. 14 illustrates a close up of the base of the partial vehicle body illustrated in FIG. 13.

References to "control circuitry" above should be understood to encompass not only computers having different architectures such as single/multi-processor architectures and sequential (Von Neumann)/parallel architectures but also specialized circuits such as field-programmable gate arrays (FPGA), application specific circuits (ASIC), signal processing devices and other processing circuitry. References to computer program instructions above should be understood to encompass software for a programmable processor or firmware such as, for example, the programmable content of a hardware device whether instructions for a processor, or configuration settings for a fixed-function device, gate array or programmable logic device, etc.

Where a structural feature has been described, it may be replaced by means for performing one or more of the functions of the structural feature whether that function or those functions are explicitly or implicitly described.

The term 'comprise' is used in this document with an inclusive not an exclusive meaning. That is any reference to X comprising Y indicates that X may comprise only one Y or may comprise more than one Y. If it is intended to use 'comprise' with an exclusive meaning then it will be made clear in the context by referring to "comprising only one" or by using "consisting".

In this description, reference has been made to various examples. The description of features or functions in relation to an example indicates that those features or functions are present in that example. The use of the term 'example' or 'for example' or 'can' or 'may' in the text denotes, whether explicitly stated or not, that such features or functions are present in at least the described example, whether described as an example or not, and that they can be, but are not necessarily, present in some of or all other examples. Thus 'example', 'for example', 'can' or 'may' refers to a particular instance in a class of examples. A property of the instance can be a property of only that instance or a property of the class or a property of a sub-class of the class that includes some but not all of the instances in the class. It is therefore implicitly disclosed that a feature described with reference to one example but not with reference to another example, can where possible be used in that other example as part of a working combination but does not necessarily have to be used in that other example.

Although examples have been described in the preceding paragraphs with reference to various examples, it should be appreciated that modifications to the examples given can be made without departing from the scope of the claims. For example, a blast countermeasure 200, 200*a*, 200*b*, 200*c* need not be placed between a cabin floor 240 and a blast shield 250 of a vehicle. In some instances, one or more blast countermeasures 200, 200*a*, 200*b*, 200*c* could be positioned on the exterior of a vehicle, such as an armoured vehicle.

A blast countermeasure 200, 200*a*, 200*b*, 200*c* need not include a shock wave attenuator 206 or a further shock wave attenuator 208. In instances where a blast countermeasure 200, 200*a*, 200*b*, 200*c*, is positioned on the exterior of a vehicle, attenuation of an upwardly directed portion of a shock wave generated by the blast countermeasure might be unnecessary, because that portion of the shock wave might have little to no impact on the vehicle and its occupants.

Even in circumstances where the blast countermeasure 200, 200*a*, 200*b*, 200*c* is positioned between the cabin floor 240 and the blast shield 250, the shock wave attenuator 206 and a further shock wave attenuator 208 might not be necessary. Presence of the reflector 218 alone or a combination of the reflector 218 and the mass 204 might be enough to reduce the impact of the portion of the shock wave that is initially directed upwards towards the cabin floor 240 following detonation of the explosive 202.

In some embodiments, the actuator 270 that is configured to generate a floor to cause the cabin floor 240 of a vehicle to retract might be a blast countermeasure 200, 200*a*, 200*b*, 200*c*. The blast countermeasure 200, 200*a*, 200*b*, 200*c* might simultaneously provide a groundwards force to a vehicle (e.g. a blast shield 250 of a vehicle) and provide a force to retract the cabin floor 240.

The separator 1274 might not be a ceramic block and might not completely disintegrate when the actuator 1270 is actuated.

Alternative coupling means, different from the levers 231, 232, may be provided to couple the blast countermeasures 200*c* to the cabin floor 240.

Features described in the preceding description may be used in combinations other than the combinations explicitly described above.

Although functions have been described with reference to certain features, those functions may be performable by other features whether described or not.

Although features have been described with reference to certain examples, those features may also be present in other examples whether described or not.

The term 'a' or 'the' is used in this document with an inclusive not an exclusive meaning. That is any reference to X comprising a/the Y indicates that X may comprise only one Y or may comprise more than one Y unless the context clearly indicates the contrary. If it is intended to use 'a' or 'the' with an exclusive meaning then it will be made clear in the context. In some circumstances the use of 'at least one' or 'one or more' may be used to emphasis an inclusive meaning but the absence of these terms should not be taken to infer an exclusive meaning.

The presence of a feature (or combination of features) in a claim is a reference to that feature or (combination of features) itself and also to features that achieve substantially the same technical effect (equivalent features). The equivalent features include, for example, features that are variants and achieve substantially the same result in substantially the same way. The equivalent features include, for example, features that perform substantially the same function, in substantially the same way to achieve substantially the same result.

In this description, reference has been made to various examples using adjectives or adjectival phrases to describe characteristics of the examples. Such a description of a characteristic in relation to an example indicates that the characteristic is present in some examples exactly as described and is present in other examples substantially as described.

Whilst endeavouring in the foregoing specification to draw attention to those features believed to be of importance it should be understood that the applicant may seek protection via the claims in respect of any patentable feature or combination of features hereinbefore referred to and/or shown in the drawings whether or not emphasis has been placed thereon.

I claim:

1. An armoured vehicle, comprising:

at least one detector for detecting an explosion local to the armoured vehicle;

a cabin floor;

at least one actuator, coupled to the cabin floor, for generating a force to cause at least a portion of the cabin floor to be pulled groundwards; and control circuitry configured to respond to detection of an explosion local to the armoured vehicle by activating the actuator to cause the cabin floor to move groundwards.

2. The armoured vehicle of claim 1, further comprising a tractor configured to pull at least a portion of the cabin floor groundwards in response to generation of the force by the at least one actuator.

3. The armoured vehicle of claim 2, wherein the tractor is connected to an underside of the cabin floor.

4. The armoured vehicle of claim 2, wherein the tractor comprises at least one spring, at least one rod, at least one cable and/or at least one chain.

5. The armoured vehicle of claim 1, wherein the at least one actuator comprises an explosively driven actuator.

6. The armoured vehicle of claim 5, wherein the explosively driven actuator comprises multiple explosive cartridges, each explosive cartridge enabling a force to be generated to cause at least a portion of the cabin floor to be pulled groundwards on a separate occasion.

7. The armoured vehicle of claim 1, wherein at least a portion of the cabin floor is fixedly positioned within the vehicle.

8. The armoured vehicle of claim 7, wherein the cabin floor is configured to flex upon actuation of the at least one actuator.

9. The armoured vehicle of claim 8, wherein the cabin floor is configured to return to its original position after generation of the groundwards force by the actuator.

10. The armoured vehicle of claim 7, wherein the cabin floor is fixedly positioned within the vehicle along at least a portion of the periphery of the cabin floor, and the portion of the cabin floor that is pulled groundwards upon actuation of the at least one actuator is located away from the periphery of the cabin floor.

11. An apparatus, comprising:

at least one detector for detecting an explosion local to an armoured vehicle;

at least one actuator, for coupling to a cabin floor of the armoured vehicle, configured to generate a force to cause at least a portion of the cabin floor to be pulled groundwards; and control circuitry configured to respond to detection of an explosion local to the armoured vehicle by activating the actuator to cause the cabin floor to move groundwards.

12. A method, comprising:

detecting an explosion local to an armoured vehicle; and pulling a cabin floor of the armoured vehicle groundwards in response to detection of the explosion.

13. The apparatus of claim 11, further comprising a tractor for pulling at least a portion of the cabin floor groundwards in response to generation of the force by the at least one actuator.

14. The apparatus of claim 13, wherein the tractor is for connection to an underside of the cabin floor.

15. The apparatus of claim 13, wherein the tractor comprises at least one spring, at least one rod, at least one cable and/or at least one chain.

16. The apparatus of claim 11, wherein the at least one actuator comprises an explosively driven actuator.

17. The apparatus of claim 16, wherein the explosively driven actuator comprises multiple explosive cartridges, each explosive cartridge enabling a force to be generated to cause at least a portion of the cabin floor to be pulled groundwards on a separate occasion.

18. The apparatus of claim 11, wherein the cabin floor is configured to flex upon actuation of the at least one actuator.

19. The apparatus of claim 18, wherein the cabin floor is configured to return to its original position after generation of the groundwards force by the actuator.

20. An armoured vehicle, comprising:

a blast shield located at the underside of the armoured vehicle;

at least one detector for detecting an explosion local to the armoured vehicle;

a cabin floor;

at least one actuator, coupled to the cabin floor, for generating a force to cause at least a portion of the cabin floor to move groundwards relative to the blast shield while the actuator remains coupled to the cabin floor; and control circuitry configured to respond to detection of an explosion local to the armoured vehicle by activating the actuator to cause the cabin floor to move groundwards.

* * * * *